US008851468B2

(12) United States Patent
Tokuma

(10) Patent No.: US 8,851,468 B2
(45) Date of Patent: Oct. 7, 2014

(54) SHEET STACKING APPARATUS AND IMAGE FORMING APPARATUS

(71) Applicant: Canon Kabushiki Kaisha, Tokyo (JP)

(72) Inventor: Naoto Tokuma, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/856,589

(22) Filed: Apr. 4, 2013

(65) Prior Publication Data

US 2013/0285320 A1 Oct. 31, 2013

(30) Foreign Application Priority Data

Apr. 27, 2012 (JP) ..... 2012-103013

(51) Int. Cl.
*B65H 43/04* (2006.01)
*B65H 29/00* (2006.01)

(52) U.S. Cl.
CPC ..... *B65H 29/00* (2013.01)
USPC ..... 271/215; 271/217; 271/220

(58) Field of Classification Search
CPC ..... B65H 31/06; B65H 2301/4214; B65H 31/10; B65H 2301/42146; B65H 31/20; B65H 3/18; B65H 43/06; B65H 31/32; B65H 31/34; B65H 2801/06; B65H 29/66
USPC ..... 271/214, 215, 217, 220
See application file for complete search history.

(56) References Cited

U.S. PATENT DOCUMENTS

| | | | | |
|---|---|---|---|---|
| 6,889,974 | B2 * | 5/2005 | Tamura et al. | 271/220 |
| 7,380,786 | B2 | 6/2008 | Tamura et al. | |
| 2012/0313317 | A1 | 12/2012 | Gamo et al. | |
| 2012/0319346 | A1 | 12/2012 | Iwata et al. | |
| 2013/0026695 | A1 | 1/2013 | Tokuma | |

* cited by examiner

*Primary Examiner* — David H Bollinger
(74) *Attorney, Agent, or Firm* — Fitzpatrick, Cella, Harper & Scinto

(57) ABSTRACT

A finisher includes: a bundle discharge roller pair; a sheet stacking portion which has a lower stacking tray, an abutment member on which a sheet is abuttable, and a sheet stacking height detecting sensor detecting a height of the sheets on the abutment member side, the sheet stacking portion configured to stack the sheet while lowering the lower stacking tray in accordance with a detection result; tray paddles coming into contact with the discharged sheet in a direction from a top of the sheet, to bring the sheet into abutment on the abutment member; a stacking amount detecting portion detecting a stacking amount of the stacked sheet, and a finisher control portion performing control of reducing a relative distance between the tray paddles and the sheet stacked on the lower stacking tray at the time of transporting of the sheet along with increase in the stacking amount of the sheet.

20 Claims, 19 Drawing Sheets

SHEET STACKING APPARATUS AND IMAGE FORMING APPARATUS

BACKGROUND OF THE INVENTION

1. Field of the Invention

The present invention relates to a sheet stacking apparatus and an image forming apparatus, and more particularly, to a sheet stacking apparatus capable of aligning sheets stacked on a stacking tray, and an image forming apparatus including the sheet stacking apparatus.

2. Description of the Related Art

Conventionally, there has been known a sheet stacking apparatus capable of aligning sheets, which are discharged onto a stacking tray for stacking the sheets thereon, in a sheet discharge direction (hereinafter referred to simply as "discharge direction") and a sheet width direction (hereinafter referred to simply as "width direction") orthogonal to the discharge direction (see U.S. Pat. No. 7,380,786).

For example, in the sheet stacking apparatus disclosed in U.S. Pat. No. 7,380,786, when a sheet discharge portion discharges a sheet onto the stacking tray having an inclined stacking surface, a transporting portion transports the sheet toward an upstream side to bring an upstream edge of the sheet into abutment on an abutment member, thereby aligning the sheet in the discharge direction. A pair of alignment members is moved in the width direction, and the pair of alignment members is brought into abutment on both edges of the sheet in the width direction, thereby aligning the sheet in the width direction. This operation is performed every time a sheet is discharged, and the sheets are stacked while lowering the stacking tray so that the stacking height (top surface position) of the sheets stacked on the stacking tray does not exceed a predetermined height.

In the above-mentioned sheet stacking apparatus, an angle $\alpha$ formed between a stacking surface of a stacking tray 1137 and an abutment surface 1170 of the abutment member is acute. Therefore, when the upstream edge of a sheet abuts on the abutment surface 1170, the upstream edge may be subjected to a downward force so that the sheet is curved, resulting in a convex shape as indicated by the dotted line Sb of FIG. 19A. When sheets discharged from a sheet discharge roller pair 1130 are sequentially stacked in such a shape, an air space is formed between parts of the sheets on the abutment member side. Consequently, as illustrated in FIG. 19B, a top sheet height Ha on the abutment member side becomes relatively larger than a top sheet height Hb at the center portion in the discharge direction. Therefore, as the number of stacked sheets increases, the inclination of the sheets at a part on the downstream side of the center portion in the discharge direction is gradually reduced to approximate a horizontal posture.

A transporting portion 1301 of the above-mentioned sheet stacking apparatus moves to appear from the abutment member side into a predetermined transporting position on the stacking surface of the stacking tray 1137 to transport the sheet on the stacking tray toward the abutment member side. The stacking height of the sheets is controlled by lowering with reference to the height Ha on the abutment member side so as not to affect the discharge of the sheet from the sheet discharge portion. Therefore, when the height Ha on the abutment member side becomes relatively larger than the height Hb at the center portion in the discharge direction as the stacking amount increases, the stacking height of the sheets at the transporting position of the transporting portion may become smaller, and as a result, the pressure of contact between the transporting portion and the sheet may decrease.

Accordingly, the transporting portion cannot transport the sheet so that stack misalignment may occur.

The discharged sheet is subjected to a reaction force generated when the downstream edge thereof lands on the inclined stacking surface of the stacking tray 1137, and to a sliding resistance force generated between the discharged sheet and the top surface of the sheets stacked on the stacking tray 1137 after the landing. Those forces serve as braking forces to stop the sheet after sliding by a predetermined distance. When the stacking amount of the sheets increases, the inclination of the top surface of the sheets stacked on the stacking tray 1137, which serves as a landing site of the downstream edge of the discharged sheet, is reduced to approximate a horizontal posture. Therefore, the landing reaction force and the sliding resistance force decrease and, accordingly, the sliding distance (traveling amount) increases. When the stacking amount of the sheets increases, the sheet travels away and is then stacked on the top surface of the stacked sheet having small inclination. Therefore, the sheet does not sufficiently return along the inclined surface due to the self-weight of the sheet so that stack misalignment may occur.

SUMMARY OF THE INVENTION

The present invention provides a sheet stacking apparatus capable of preventing stack misalignment of multiple sheets stacked on a stacking tray, and an image forming apparatus including the sheet stacking apparatus.

According to an exemplary embodiment of the present invention, there is provided a sheet stacking apparatus including: a sheet discharge portion configured to discharge a sheet; a sheet stacking portion comprising: a stacking tray on which the sheet discharged from the sheet discharge portion is stacked; an abutment member formed below the sheet discharge portion so that an end portion of the sheet stacked on the stacking tray is abuttable on the abutment member; and a sheet stacking height detecting sensor configured to detect a top surface position on the abutment member side of the sheet, which is stacked on the stacking tray, in a sheet stacking height direction, the sheet stacking portion configured to stack the sheet while lowering the stacking tray in accordance with a detection result obtained from the sheet stacking height detecting sensor; a transporting portion provided above the stacking tray so as to be capable of raising and lowering in the sheet stacking height direction, the transporting portion configured to come into contact with the sheet, which is discharged from the sheet discharge portion, in a direction from a top of the sheet to transport the sheet toward the abutment member and bring the sheet into abutment on the abutment member; a stacking amount detecting portion configured to detect a stacking amount of the sheet stacked on the stacking tray; and a control portion configured to perform control of lowering a position of the transporting portion in the sheet stacking height direction at the time of transporting of the sheet along with increase in the stacking amount of the sheet, which is detected by the stacking amount detecting portion.

According to another exemplary embodiment of the present invention, there is provided an image forming apparatus including: an image forming portion configured to form an image on a sheet; a sheet discharge portion configured to discharge the sheet on which the image is formed by the image forming portion; a sheet stacking portion comprising: a stacking tray on which the sheet discharged from the sheet discharge portion is stacked; an abutment member formed below the sheet discharge portion so that an end portion of the sheet stacked on the stacking tray is abuttable on the abutment member; and a sheet stacking height detecting sensor configured to detect a top surface position on the abutment member side of the sheet, which is stacked on the stacking tray, in a sheet stacking height direction, the sheet stacking portion configured to stack the sheet while lowering the stacking tray in accordance with a detection result obtained from the sheet stacking height detecting sensor; a transporting portion provided above the stacking tray so as to be capable of raising and lowering in the sheet stacking height direction, the transporting portion configured to come into contact with the sheet, which is discharged from the sheet discharge portion, in a direction from a top of the sheet to transport the sheet toward the abutment member and bring the sheet into abutment on the abutment member; a stacking amount detecting portion configured to detect a stacking amount of the sheet stacked on the stacking tray; and a control portion configured to perform control of lowering a position of the transporting portion in the sheet stacking height direction at the time of transporting of the sheet along with increase in the stacking amount of the sheet, which is detected by the stacking amount detecting portion.

According to the present invention, when the stacking amount of the sheets stacked on the stacking tray increases, the relative distance between the topmost sheet on the stacking tray and the transporting portion is reduced. Accordingly, it is possible to prevent the stack misalignment of multiple sheets stacked on the stacking tray.

Further features of the present invention will become apparent from the following description of exemplary embodiments with reference to the attached drawings.

DESCRIPTION OF THE EMBODIMENTS

In the following, an image forming apparatus including a sheet stacking apparatus according to an exemplary embodiment of the present invention is described with reference to the attached drawings. The image forming apparatus according to this embodiment is typified by a copying machine, a printer, a facsimile machine, and a multifunction peripheral combining those apparatus, and includes a sheet stacking apparatus capable of alignment processing for sheets stacked on a stacking tray. In the embodiment described below, a monochrome/color multifunction peripheral (hereinafter referred to as "multifunction peripheral") 1 is used as the image forming apparatus.

Figure 1:
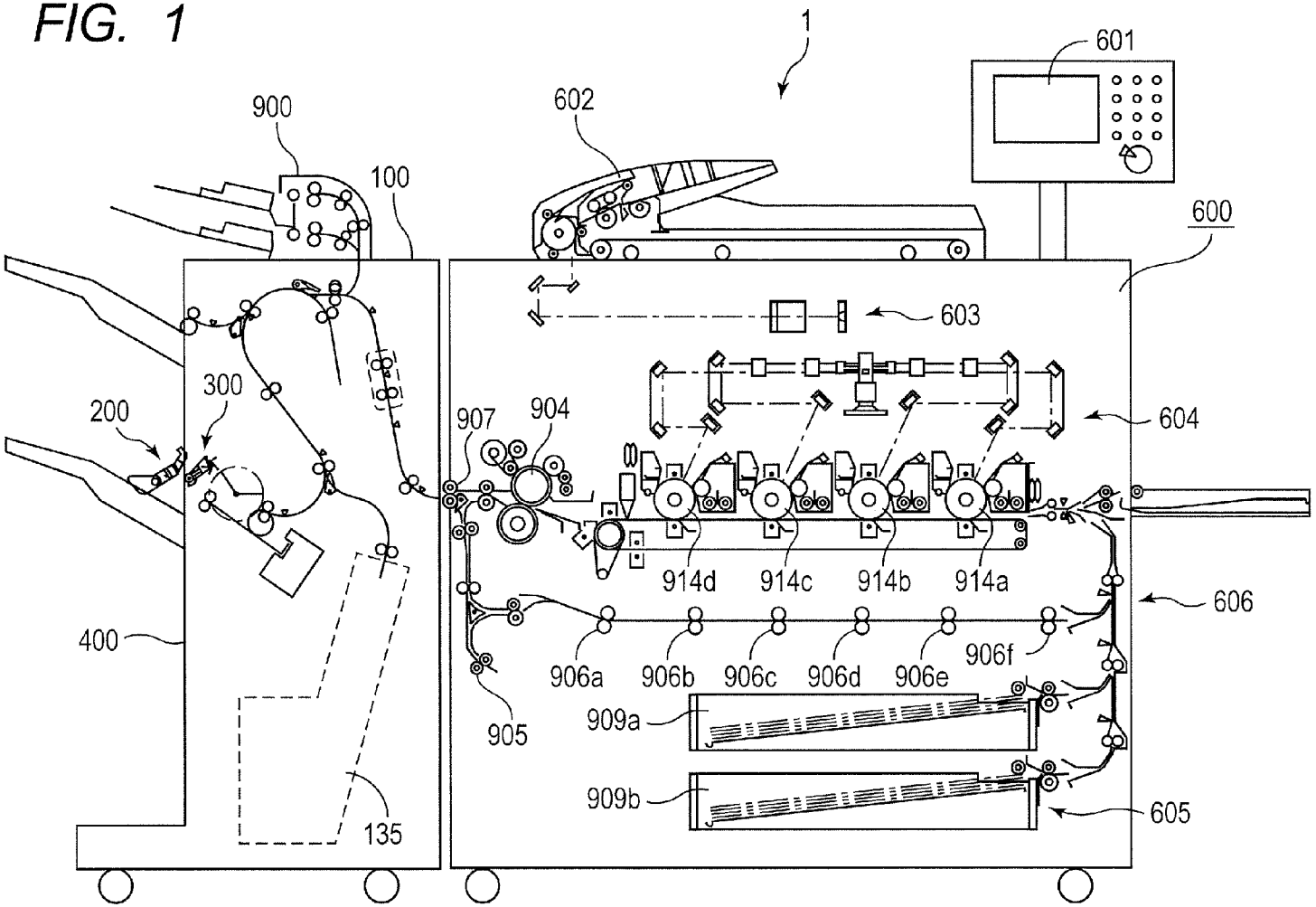
FIG. 1 is a schematic sectional view illustrating the entire structure of a multifunction peripheral according to an embodiment.
Figure 2:
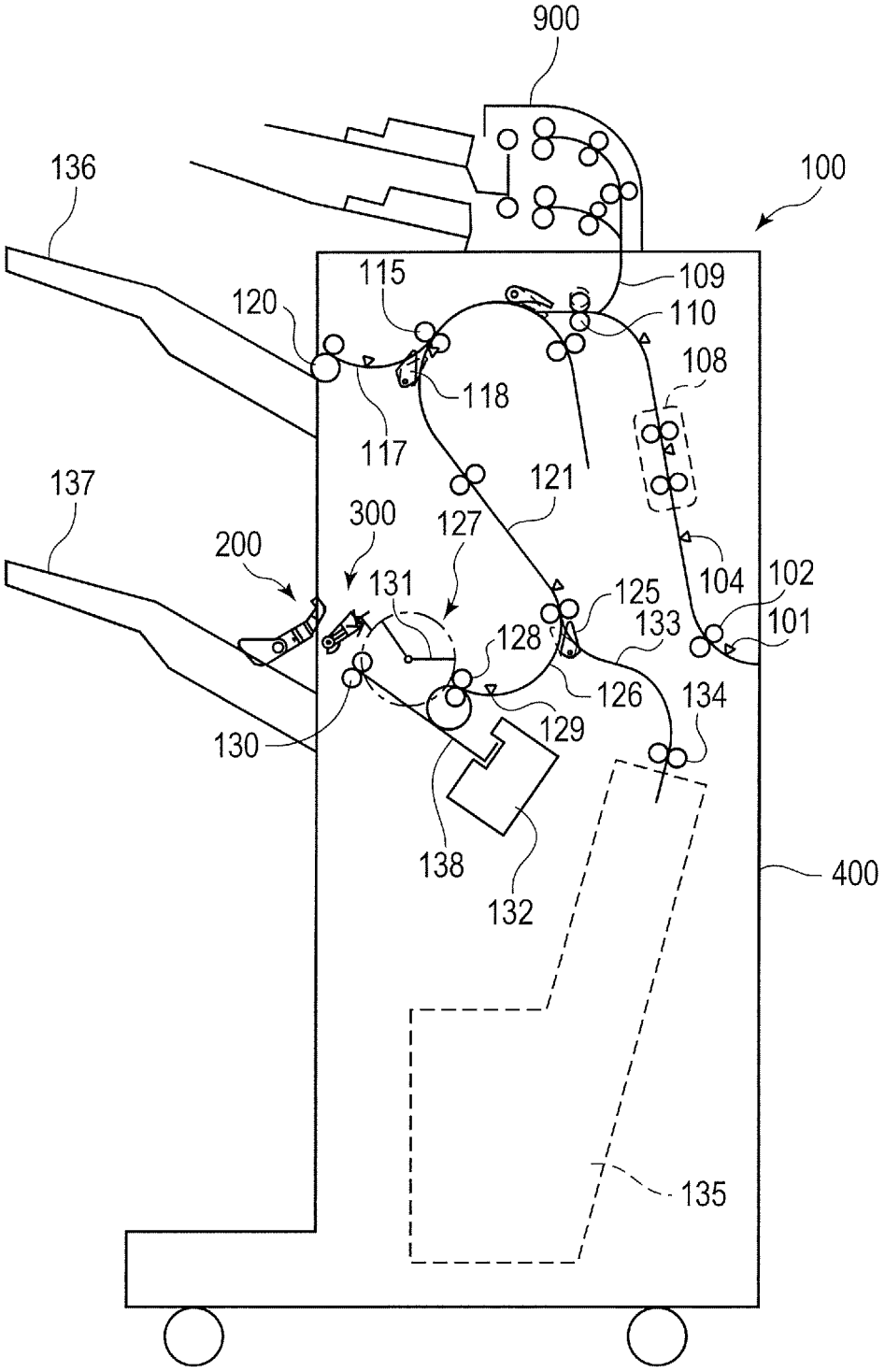
FIG. 2 is a schematic sectional view illustrating a finisher according to the embodiment.

In the following, the multifunction peripheral 1 according to the embodiment of the present invention is described with reference to FIGS. 1 to 18. First, referring to FIGS. 1 and 2, the entire structure of the multifunction peripheral 1 is described based on movement of a sheet. FIG. 1 is a schematic sectional view illustrating the entire structure of the multifunction peripheral 1 according to the embodiment of the present invention. FIG. 2 is a schematic sectional view illustrating a finisher 100 according to this embodiment.

As illustrated in FIG. 1, the multifunction peripheral 1 according to this embodiment includes a copying machine 600 configured to form an image on a sheet, and the finisher 100 serving as the sheet stacking apparatus. The finisher 100 according to this embodiment is removable from the copying machine 600, and is usable as an option for the copying machine 600 that is solely usable as well.

This embodiment is described with use of the above-mentioned removable finisher 100, but in the multifunction peripheral of the present invention, the finisher 100 and the copying machine 600 may be integrated with each other. In the following, the "front" of the multifunction peripheral 1 refers to such a position that a user faces an operation portion 601 to be used for inputting and setting various items for the multifunction peripheral 1, and the "rear" refers to a position on the rear surface side of the multifunction peripheral. FIG. 1 illustrates the internal structure of the multifunction peripheral 1 as seen from the front side, and the finisher 100 is connected to the side portion of the copying machine 600.

The copying machine 600 includes the operation portion 601, an original feeding device 602 capable of feeding an original, an image reader 603 configured to read information on the original that is fed from the original feeding device 602, and an image forming portion 604 configured to form an image on a sheet. The copying machine 600 further includes a sheet storing portion 605 configured to store sheets, and a sheet feeding portion 606 configured to feed the sheets stored in the sheet storing portion 605 to the image forming portion 604.

When an original is set on the original feeding device 602 of the copying machine 600, the original feeding device 602 feeds sheets of the original one by one in an order from the top page, and the image reader 603 reads image information of the original. When the image information is read, based on the image information thus read, yellow, magenta, cyan, and black toner images are formed on photosensitive drums 914*a* to 914*d* of the image forming portion 604, respectively. In parallel to the operation of forming toner images, the sheet feeding portion 606 selectively feeds a sheet from any one of feed cassettes 909*a* and 909*b* of the sheet storing portion 605. Then, at a predetermined timing, the sheet is sent to transfer positions of the respective photosensitive drums 914*a* to 914*d*, and the toner images of the respective colors that are formed on the photosensitive drums 914*a* to 914*d* are sequentially transferred onto the sheet in a superimposed manner. After that, the unfixed toner images formed on the sheet are fixed by a fixing device 904, and the sheet is sent into the finisher 100 by a discharge roller pair 907.

In a case of duplex printing, the sheet is reversed by reversing rollers 905, and the reversed sheet is then conveyed again to the image forming portion 604 by conveyance rollers 906*a* to 906*f* provided to a reverse conveyance path. Then, the above-mentioned processing is repeated.

The finisher 100 is connected to the downstream side of the copying machine 600. The sheet sent from the copying machine 600 is introduced to the finisher 100, and saddle stitch processing and the like can be performed online. As illustrated in FIG. 2, the finisher 100 includes a finisher main body 400, and an inserter 900 capable of inserting a sheet to a conveyance path 109 inside the finisher main body 400. The inserter 900 is provided above the finisher main body 400, and is configured to insert an insertion sheet, for example, to the top page or last page of the sheet bundle, or between the sheets having images formed by the copying machine 600.

The sheet sent from the copying machine 600 is first delivered to an inlet roller pair 102 of the finisher 100. At this time, an inlet sensor 101 detects a timing of the sheet delivery at the same time. During a period in which the sheet delivered to the inlet roller pair 102 is passing along the conveyance path, a lateral registration detecting sensor 104 detects a lateral registration error in a sheet width direction (hereinafter referred to simply as "width direction") with respect to the center position. When the lateral registration detecting sensor 104 detects the lateral registration error, a shift unit 108 performs a lateral registration detection processing.

When the shift unit 108 finishes the lateral registration detection processing, the sheet is conveyed by a conveyance roller pair 110, and is further conveyed to the downstream side by a buffer roller pair 115. In a case of discharging the sheet onto an upper stacking tray 136, a drive portion (not shown) such as a solenoid moves an upper path switching member 118 to a position indicated by the broken line of FIG. 2 so that the sheet is discharged onto the upper stacking tray 136 through an upper conveyance path 117 by an upper discharge roller pair 120. In a case of discharging the sheet onto a lower stacking tray 137, on the other hand, the drive portion moves the upper path switching member 118 to a position indicated by the solid line of FIG. 2 so that the sheet is conveyed to a bundle conveyance path 121.

When the sheets conveyed to the bundle conveyance path 121 are to be subjected to saddle stitch processing, a drive portion (not shown) such as a solenoid moves a saddle path switching member 125 to a position indicated by the broken line of FIG. 2. Accordingly, the sheets are guided to a saddle path 133, and conveyed to a saddle unit 135 by a saddle inlet roller pair 134 so that the saddle stitch processing is performed. Description of the saddle stitch processing is omitted herein. When the saddle stitch processing is not performed, the drive portion moves the saddle path switching member 125 to a position indicated by the solid line of FIG. 2 so that the sheets are sequentially conveyed onto a processing tray 138 of a stapling portion 127. The sheets conveyed onto the processing tray 138 are subjected to alignment processing in a sheet discharge direction (hereinafter referred to simply as "discharge direction") and in the width direction, and then subjected to binding processing with use of a stapler 132. Description of the sheet processing performed by the stapling portion 127 is omitted herein.

The sheets subjected to the predetermined sheet processing by the stapling portion 127 are discharged onto the lower stacking tray 137 serving as the stacking tray by a bundle discharge roller pair 130 serving as a sheet discharge portion. When the sheets are not subjected to the predetermined sheet processing by the stapling portion 127, the sheets are delivered from a lower discharge roller pair 128 to the bundle discharge roller pair 130, and discharged onto the lower stacking tray 137. The sheets discharged onto the lower stacking tray 137 are then aligned in the width direction and the discharge direction on the lower stacking tray 137 by a width-direction alignment portion 200 and a discharge-direction alignment portion 300. The alignment processing in the width direction that is performed by the width-direction alignment portion 200 and the alignment processing in the discharge direction that is performed by the discharge-direction alignment portion 300 are described later in detail. The stacking height (top surface position) of the sheets on the lower stacking tray 137 is detected by a sheet stacking height detecting sensor 510 described later, and the sheets are stacked on the lower stacking tray 137 while lowering the lower stacking tray 137 in accordance with a detection result from the sheet stacking height detecting sensor 510 so that the top surface of the sheets is set at a predetermined height. The lower stacking tray 137, the sheet stacking height detecting sensor 510, and an abutment member 170 constitute a sheet stacking portion, and the lower stacking tray 137 is described later in detail.

Figure 3:
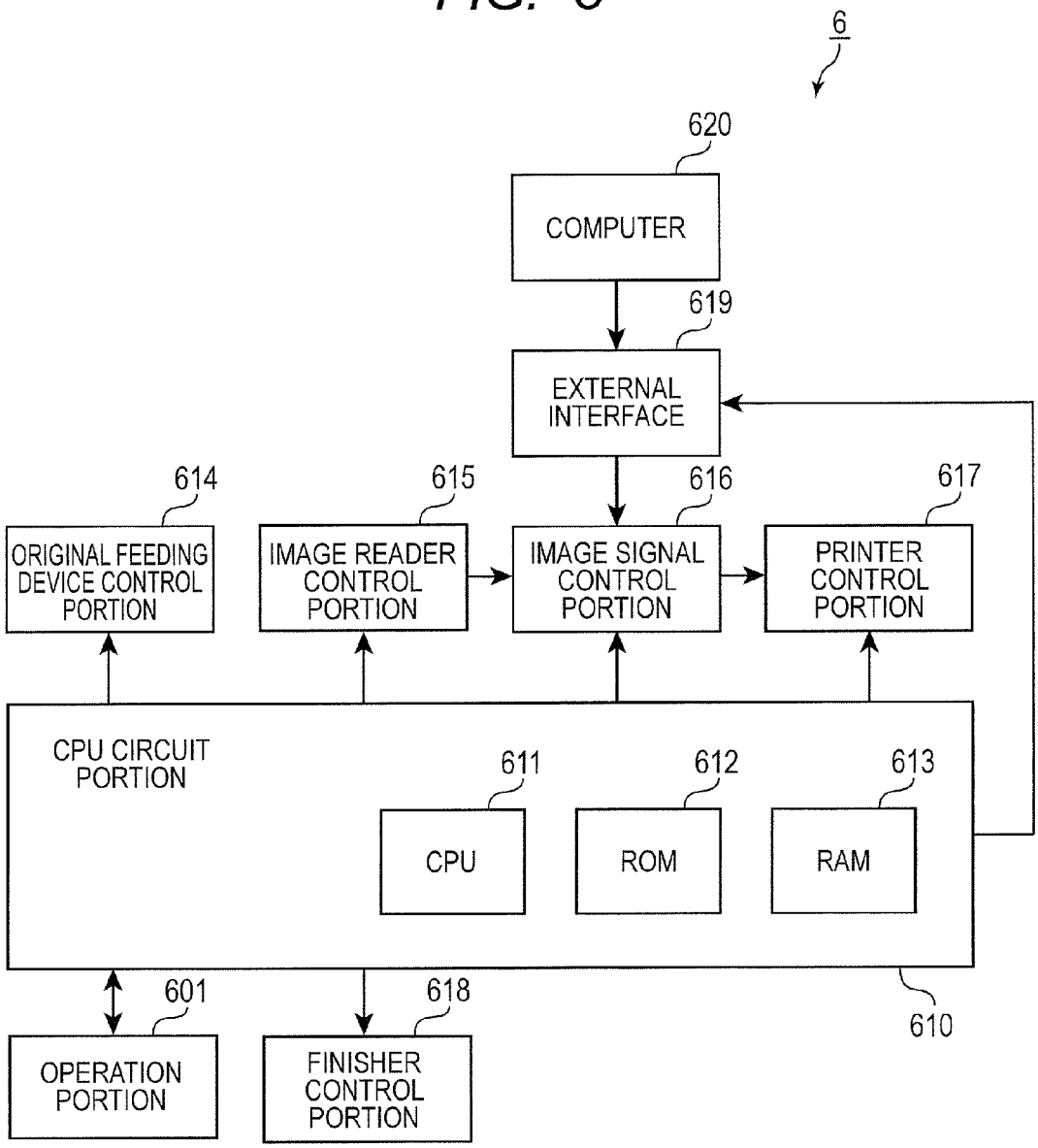
FIG. 3 is a block diagram of a control portion configured to control the multifunction peripheral according to the embodiment.
Figure 4:
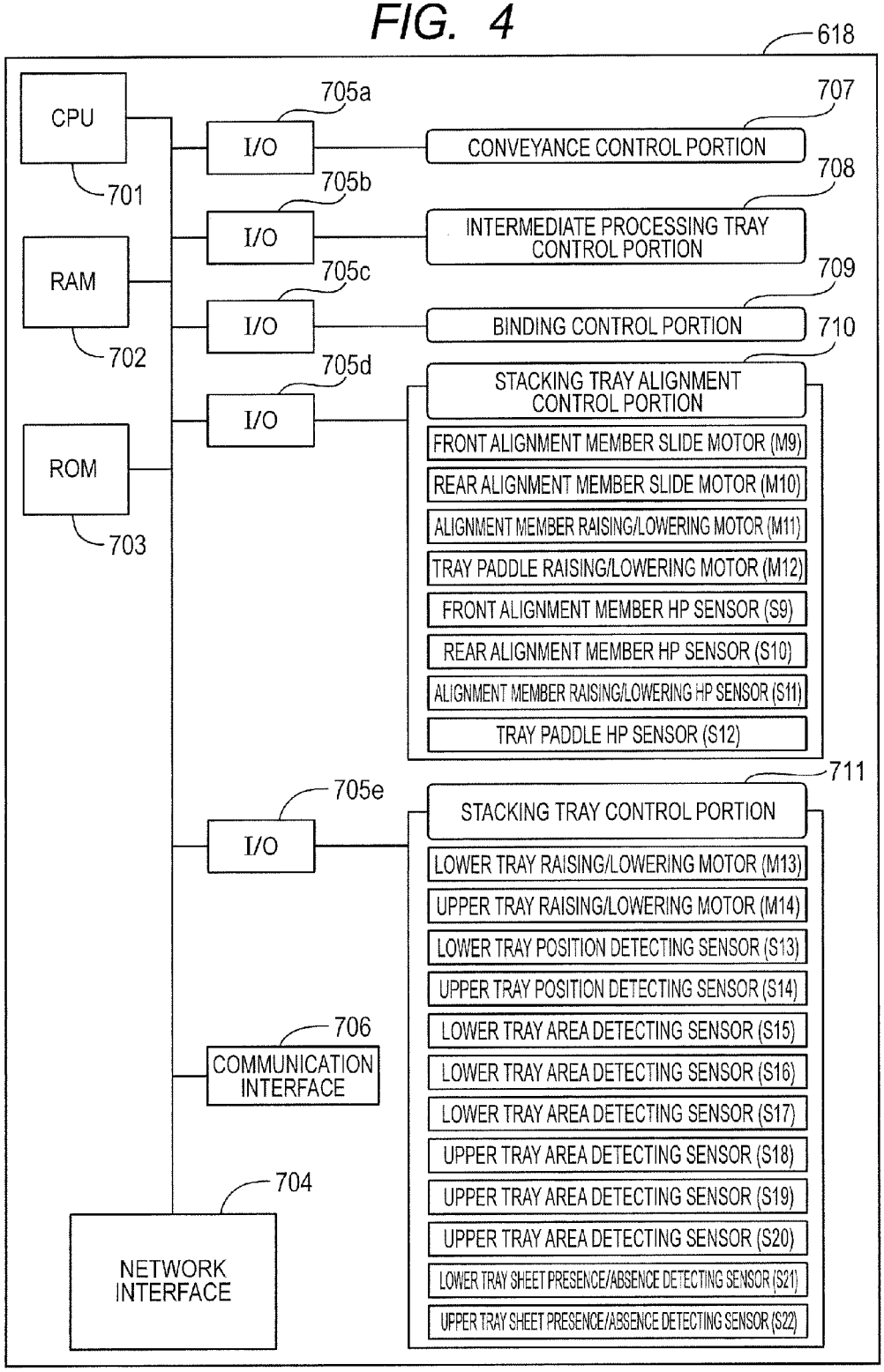
FIG. 4 is a block diagram of a finisher control portion configured to control the finisher according to the embodiment.

Next, a control portion 6 configured to control the multifunction peripheral 1 according to this embodiment is described with reference to FIGS. 3 and 4. FIG. 3 is a block diagram of the control portion 6 configured to control the multifunction peripheral 1 according to this embodiment. FIG. 4 is a block diagram of a finisher control portion 618 configured to control the finisher 100 according to this embodiment.

As illustrated in FIG. 3, the control portion 6 includes a CPU circuit portion 610, an original feeding device control portion 614, an image reader control portion 615, an image signal control portion 616, a printer control portion 617, and the finisher control portion 618. In this embodiment, the CPU circuit portion 610, the original feeding device control portion 614, the image reader control portion 615, the image signal control portion 616, and the printer control portion 617 are mounted to the copying machine 600, and the finisher control portion 618 is mounted to the finisher 100.

The CPU circuit portion 610 includes a CPU 611, a ROM 612, and a RAM 613. The CPU 611 controls the original feeding device control portion 614, the image reader control portion 615, the image signal control portion 616, the printer control portion 617, the finisher control portion 618, and the like in accordance with programs stored in the ROM 612 and instruction information input through the operation portion 601. The RAM 613 is used as an area for temporarily holding control data, and a working area for computation to be performed along with the control.

The original feeding device control portion 614 controls the original feeding device 602, and the image reader control portion 615 controls the image reader 603 configured to read information on an original that is fed from the original feeding device 602 (see FIG. 1). The data on the original that is read by the image reader control portion 615 is output to the image signal control portion 616. The printer control portion 617 controls the copying machine 600. An external interface 619 is an interface for connecting an external computer 620 and the copying machine 600 to each other, and for example, loads print data input from the computer 620 as an image and outputs the image data to the image signal control portion 616. The image data output to the image signal control portion 616 is output to the printer control portion 617, and an image is formed by the image forming portion 604.

As illustrated in FIG. 4, the finisher control portion 618 includes a CPU (microcomputer) 701, a RAM 702, a ROM 703, input/output (I/O) portions 705*a* to 705*e*, a communication interface 706, and a network interface 704. The finisher control portion 618 includes a conveyance control portion 707, an intermediate processing tray control portion 708, a binding control portion 709, a stacking tray alignment control portion 710, and a stacking tray control portion 711. The finisher control portion 618 exchanges information with the CPU circuit portion 610 to control various drive motors and sensors illustrated in FIG. 4, and to control the entire drive of the finisher 100. For example, the finisher control portion 618 causes the stacking tray alignment control portion 710, which is capable of executing proximity control described later, to execute the proximity control.

Figure 5A:
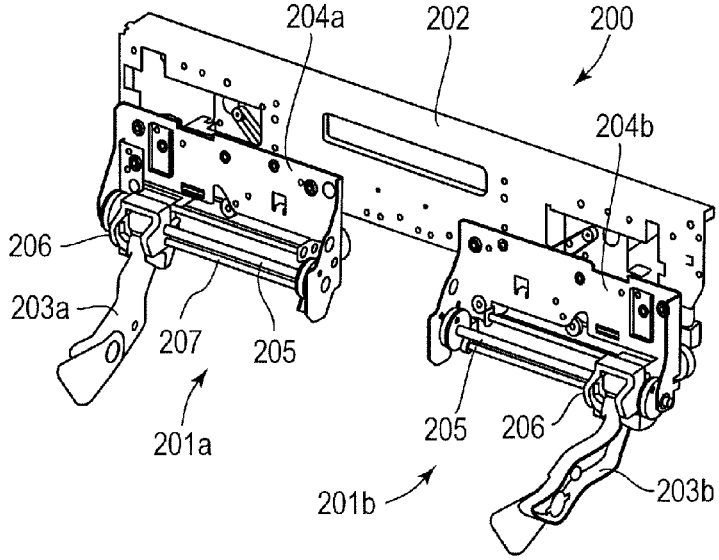
FIGS. 5A, 5B, and 5C are perspective views illustrating a width-direction alignment portion provided to the finisher according to the embodiment.
Figure 5B:
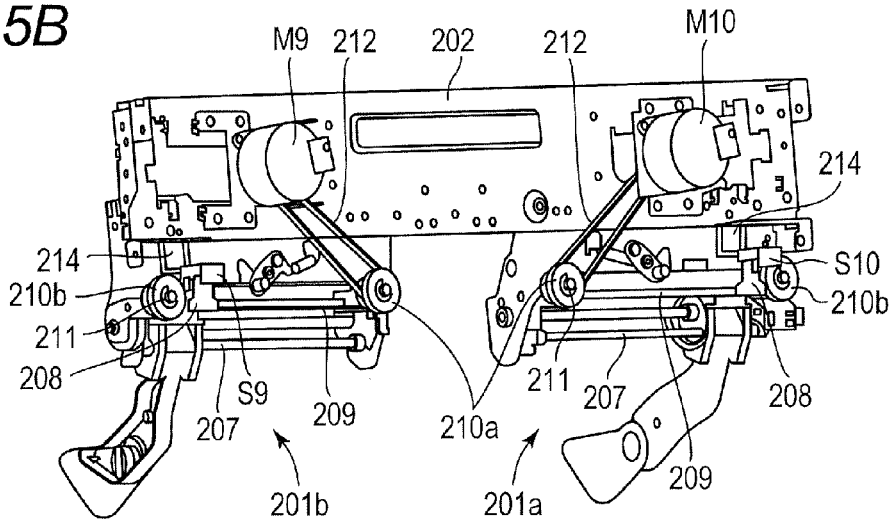
Figure 5C:
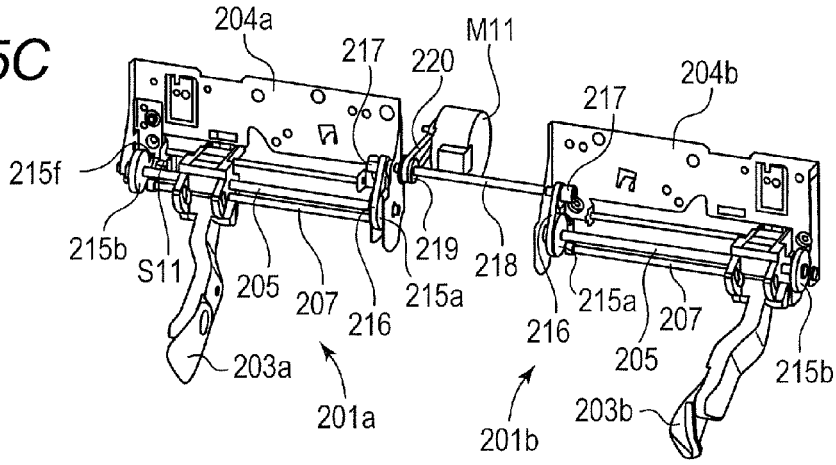

Next, the width-direction alignment portion 200 configured to perform the alignment processing in the width direction for the sheets discharged onto the lower stacking tray 137 is described with reference to FIGS. 5A to 5C in addition to FIG. 2. FIGS. 5A to 5C are perspective views illustrating the width-direction alignment portion 200 provided to the finisher 100 according to this embodiment. In the following, the width direction is referred to as "front-rear direction".

As illustrated in FIG. 2, the width-direction alignment portion 200 is provided above the lower stacking tray 137. As illustrated in FIGS. 5A to 5C, the width-direction alignment portion 200 includes a front alignment unit 201*b* arranged on the front side, a rear alignment unit 201*a* arranged on the rear side, an upper stay 202, an alignment member raising/lowering motor M11, and an alignment member raising/lowering HP sensor S11. The front alignment unit 201*b* and the rear alignment unit 201*a* are mounted symmetrically in the front-rear direction with respect to the upper stay 202, and the upper stay 202 is supported by the finisher main body 400.

The front alignment unit 201*b* includes an arm-like front alignment member 203*b*, a pulley support plate 204*b*, a front alignment member slide motor M9, and a front alignment member HP sensor S9. The rear alignment unit 201*a* includes an arm-like rear alignment member 203*a*, a pulley support plate 204*a*, a rear alignment member slide motor M10, and a rear alignment member HP sensor S10. The front alignment unit 201*b* and the rear alignment unit 201*a* basically have the same structure. Therefore, the structure of the rear alignment unit 201*a* is described herein. For the front alignment unit 201*b*, the same reference symbols are used, and description thereof is therefore omitted herein.

The rear alignment member 203*a* has a proximal end portion supported by a slide member 206. The slide member 206 is supported to be slidable and rotatable about a first alignment spindle 205. The slide member 206 sandwiches a second slide drive transmission belt 209 with a slide position detecting member 208, and the second slide drive transmission belt 209 is looped around a pair of slide drive transmission pulleys 210*a* and 210*b*. The slide drive transmission pulleys 210*a* and 210*b* are each supported by a pulley spindle 211 coupled by caulking to the pulley support plate 204*a*, and the slide drive transmission pulley 210*a* is connected to the rear alignment member slide motor M10 through an intermediation of a first slide drive transmission belt 212.

The rear alignment member 203*a* moves in the front-rear direction by the slide member 206 sliding along the first alignment spindle 205 through the drive of the rear alignment member slide motor M10, and brings a tip end portion thereof into contact with the edge portion of the sheet in the width direction to align the sheet in the width direction. At this time, the rear alignment member HP sensor S10 fixed to the upper stay 202 through an intermediation of an alignment position detecting support plate 214 detects the home position of the rear alignment member 203*a* in the front-rear direction. Based on the detected home position and the like, the stacking tray alignment control portion 710 of the finisher control portion 618 performs movement control in the front-rear direction. The home position of the rear alignment member 203*a* in the front-rear direction is a position in the front-rear direction at which the sheet can be discharged onto the lower stacking tray 137.

The first alignment spindle 205 is supported by alignment member raising/lowering pulleys 215*a* and 215*b*. The alignment member raising/lowering pulley 215*a* is connected to a second raising/lowering pulley 217 through an intermediation of a drive transmission belt 216. The second raising/lowering pulley 217 is fixed to a raising/lowering transmission shaft 218 in a D-cut shape, and a third raising/lowering pulley 219 is connected to the raising/lowering transmission shaft 218. The third raising/lowering pulley 219 is connected to the alignment member raising/lowering motor M11 through an intermediation of a drive transmission belt 220.

The rear alignment member 203*a* is raised and lowered when the first alignment spindle 205 rotates via the raising/lowering transmission shaft 218 through the drive of the alignment member raising/lowering motor M11. At this time, the pivot amount of the rear alignment member 203*a* is restricted by a second alignment spindle 207. A flag portion 215*f* provided to the alignment member raising/lowering pulley 215*b* turns ON and OFF the alignment member raising/lowering HP sensor S11 configured to detect the home position of the rear alignment member 203*a* in the raising/lowering direction. Accordingly, the home position of the rear alignment member 203*a* in the raising/lowering direction is detected. Based on the detected home position in the raising/lowering direction and the like, the stacking tray alignment control portion 710 of the finisher control portion 618 performs movement control of a raising/lowering position. The rear alignment member 203*a* and the front alignment member 203*b* are coupled to each other through an intermediation of the raising/lowering transmission shaft 218. Therefore, the front alignment member 203*b* is synchronized with the control of a raising/lowering position of the rear alignment member 203*a* by the stacking tray alignment control portion 710. The home position in the raising/lowering direction is a position in the raising/lowering direction at which the sheet can be discharged onto the lower stacking tray 137.

Figure 6A:
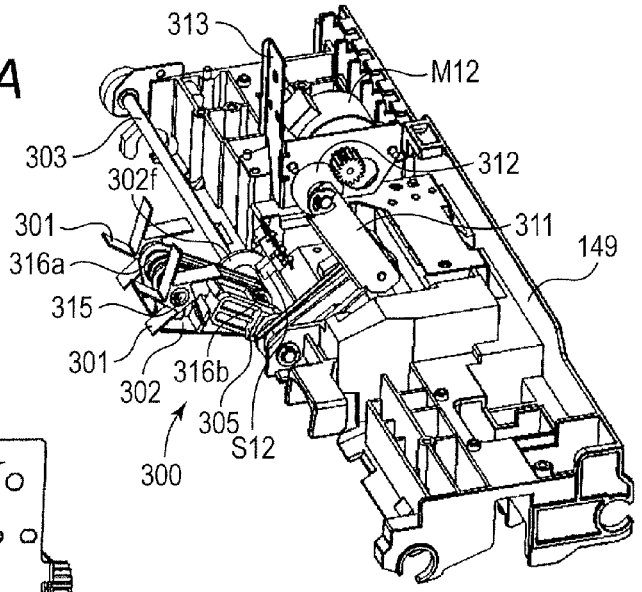
FIGS. 6A, 6B, and 6C are perspective views illustrating a discharge-direction alignment portion provided to the finisher according to the embodiment.
Figure 6B:
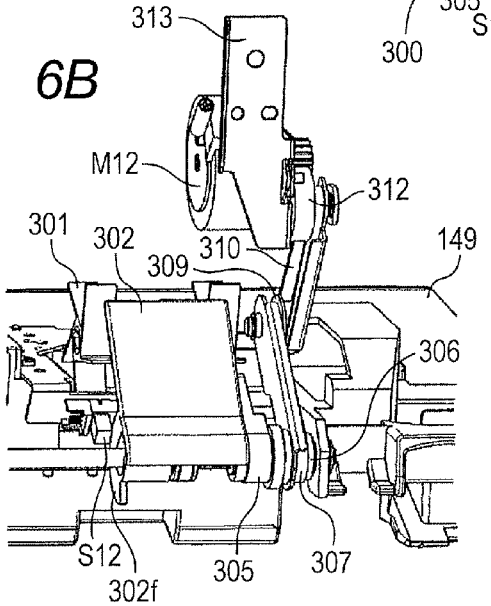
Figure 6C:
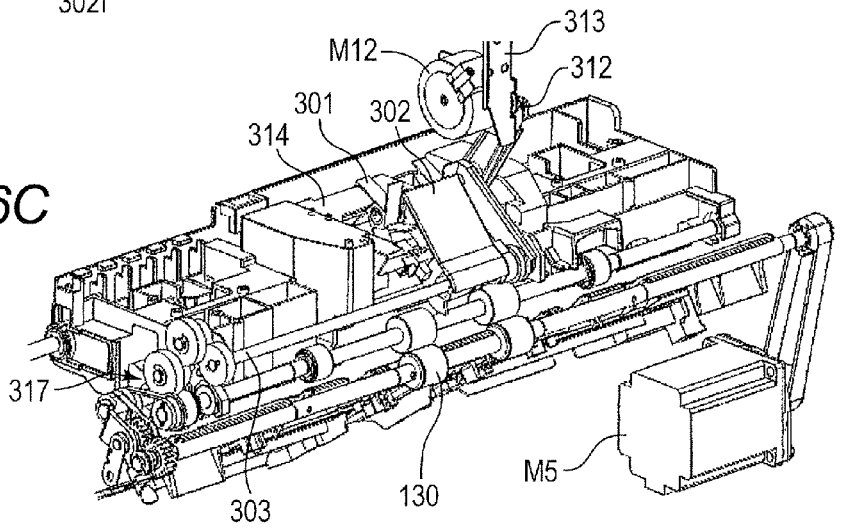
Figure 7A:
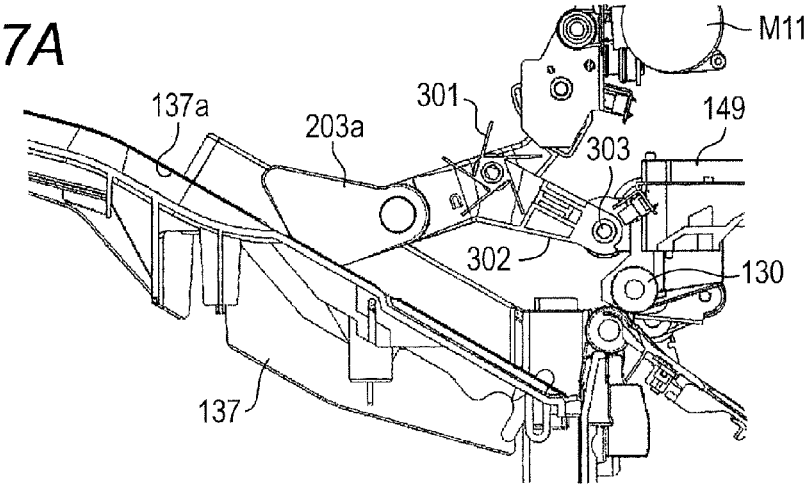
FIGS. 7A, 7B, and 7C illustrate a standby position and transporting positions of tray paddles of the discharge-direction alignment portion according to the embodiment.
Figure 7B:
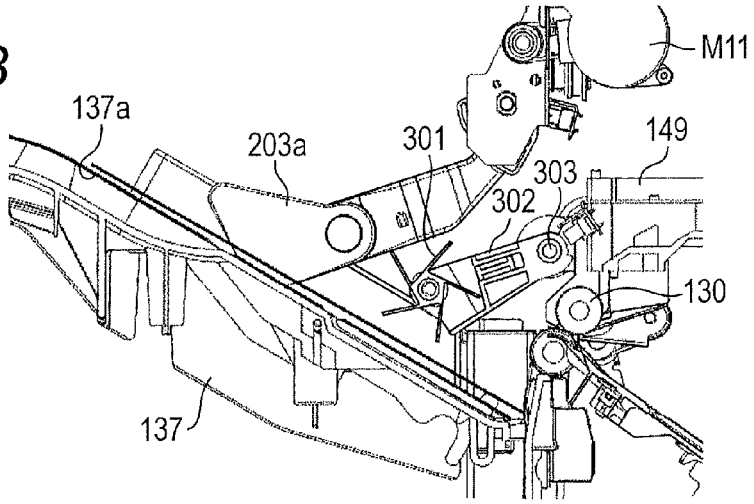
Figure 7C:
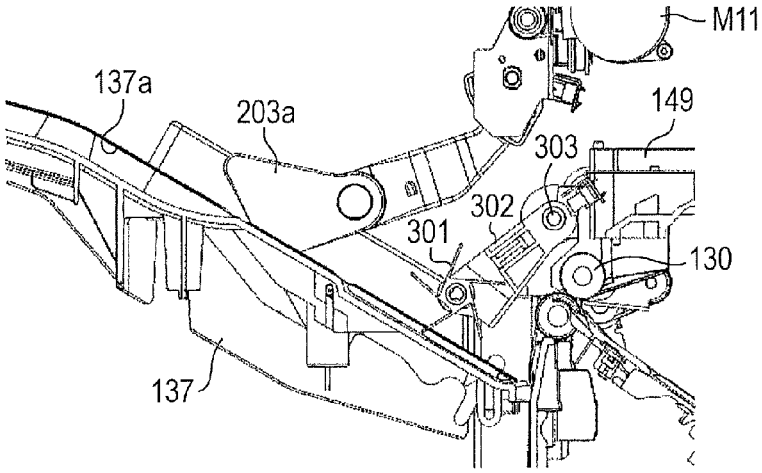

Next, the discharge-direction alignment portion 300 configured to perform the alignment processing in the discharge direction for the sheet discharged onto the lower stacking tray 137 is described with reference to FIGS. 6A to 6C and 7A to 7C in addition to FIG. 2. FIGS. 6A to 6C are perspective views illustrating the discharge-direction alignment portion 300 provided to the finisher 100 according to this embodiment. FIGS. 7A to 7C illustrate a standby position and transporting positions of tray paddles 301 of the discharge-direction alignment portion 300 according to this embodiment, respectively.

As illustrated in FIG. 2, the discharge-direction alignment portion 300 is provided above the lower stacking tray 137. The discharge-direction alignment portion 300 is supported by a substantially center portion of an upper opening/closing guide 149 provided so as to be located above the bundle discharge roller pair 130. The discharge-direction alignment portion 300 lowers the tray paddles 301 described later while rotating the tray paddles 301 from above the bundle discharge roller pair 130, to thereby bring the sheets discharged from the bundle discharge roller pair 130 into abutment on the abutment member 170 while dropping the sheets onto the lower stacking tray 137. The abutment member 170 is provided below the bundle discharge roller pair 130 on an upstream side in the sheet discharge direction (hereinafter referred to simply as "upstream side") in which the sheet is discharged onto the lower stacking tray 137 (see FIGS. 11A and 11B).

As illustrated in FIGS. 6A to 6C, the discharge-direction alignment portion 300 includes the tray paddles 301 and a paddle holder 302. The tray paddles 301 and the paddle holder 302 constitute a transporting portion configured to bring the sheet into abutment on the abutment member 170.

The tray paddles 301 each have multiple paddles, and are rotatably supported at the tip end portion of the paddle holder 302. A rotation shaft 315 of the tray paddles 301 is connected to a tray return pulley 316*a*, and the tray return pulley 316*a* is connected to a tray return pulley 316*b* through an intermediation of a drive transmission belt. The tray return pulley 316*b* is connected to a holder spindle 303 rotatably supported by the upper opening/closing guide 149, and the holder spindle 303 is drivably coupled to the bundle discharge roller pair 130 through an intermediation of a gear assembly 317. That is, the tray paddles 301 rotate in synchronization with the bundle discharge roller pair 130 which rotates through the drive of a bundle discharge motor M5.

The proximal end portion of the paddle holder 302 is supported by the holder spindle 303, and engages with a paddle raising/lowering pulley 305 supported by the holder spindle 303. A raising/lowering link pulley 306 is connected to the paddle raising/lowering pulley 305, and the raising/lowering link pulley 306 is connected to a raising/lowering link pulley 309 through an intermediation of a drive transmission belt 307. The raising/lowering link pulley 309 is connected to a raising/lowering gear 312 through an intermediation of a drive transmission belt 310, and the raising/lowering gear 312 is connected to a tray paddle raising/lowering motor M12. Accordingly, the driving force of the tray paddle raising/lowering motor M12 is transmitted to the paddle holder 302 so that the paddle holder 302 is pivoted (raised and lowered). In this manner, the tray paddles 301 supported at the tip end of the paddle holder 302 are freely raised and lowered. The tray paddle raising/lowering motor M12 is fixed to a raising/lowering motor support plate 313, and the raising/lowering motor support plate 313 is fixed to the upper stay 202 (see FIGS. 5A and 5B). As described above, a driving portion, which drives the tray paddles 301, is composed of the paddle raising/lowering pulley 305, the raising/lowering link pulley 306, the drive transmission belt 307, the raising/lowering link pulley 309, the drive transmission belt 310, the raising/lowering gear 312, and the tray paddle raising/lowering motor M12.

The home position of the paddle holder 302 is detected by a flag portion 302*f* of the paddle holder 302 blocking a tray paddle HP sensor S12 that is fixed to the upper opening/closing guide 149. Based on the detected home position and the like, the stacking tray alignment control portion 710 performs movement control for the pivot position. For example, the movement of the paddle holder 302 is controlled to switch between a receiving position of FIG. 7A, at which the sheet is received at a position above the bundle discharge roller pair 130, and a first transporting position of FIG. 7B, at which the sheet on the lower stacking tray 137 is brought into abutment on the abutment member 170. The paddle holder 302 pivots further downward from the first transporting position, and the movement thereof is controlled to switch to a second transporting position of FIG. 7C, at which the relative distance between the paddle holder 302 and the topmost sheet stacked on the lower stacking tray 137 is reduced. Further, after the job is finished, the paddle holder 302 moves to the home position, at which the paddle holder 302 is housed in the upper opening/closing guide 149 (see, for example, FIG. 6B). In this manner, the movement of the paddle holder 302 (tray paddles 301) according to this embodiment is controlled to switch among the home position, the receiving position, the first transporting position, and the second transporting position. The movement control is described later in detail.

Figure 8A:
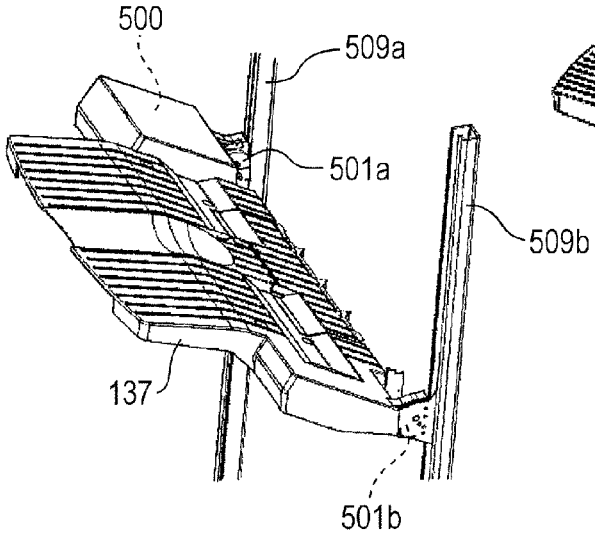
FIGS. 8A, 8B, and 8C are perspective views illustrating a lower stacking tray provided to the finisher according to the embodiment.
Figure 8B:
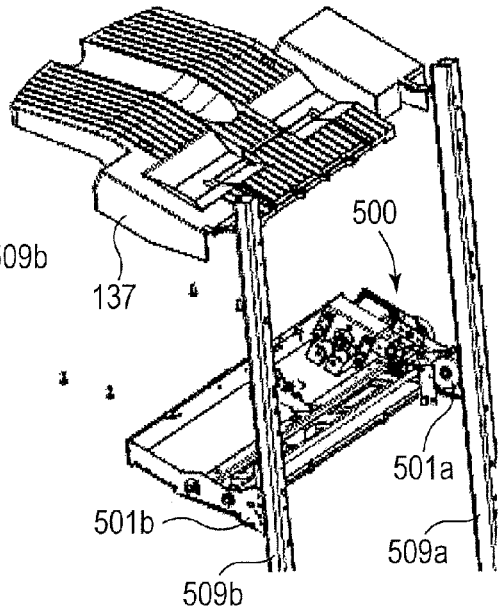
Figure 8C:
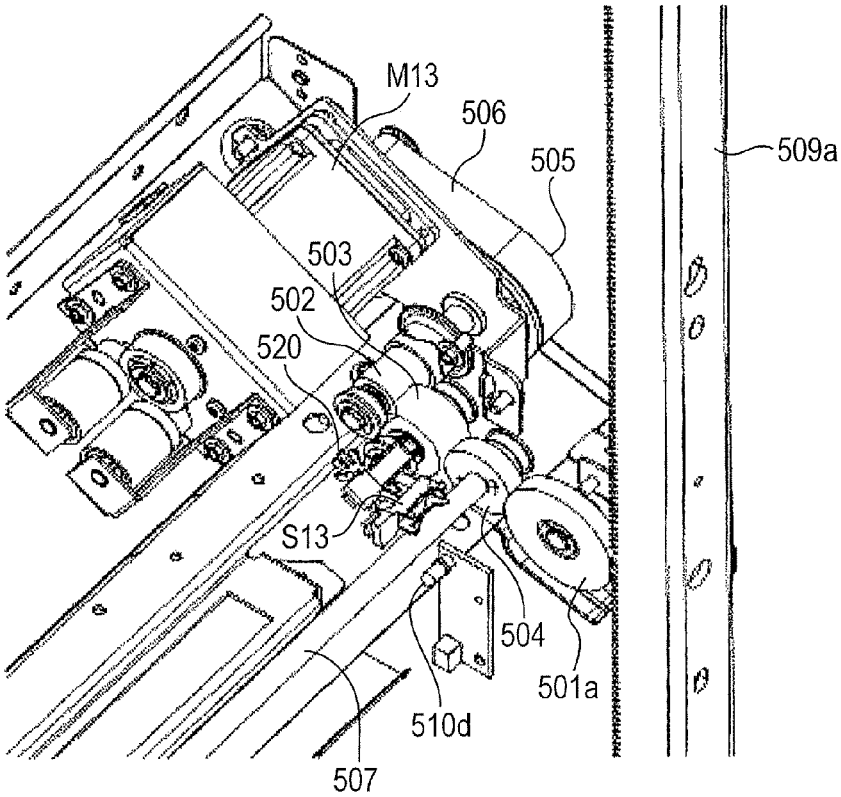
Figure 9A:
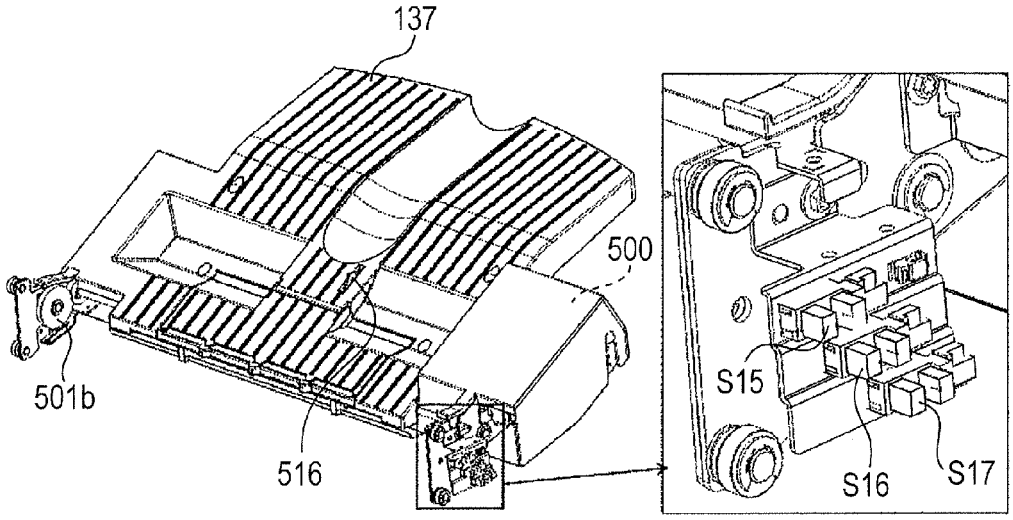
FIGS. 9A and 9B are perspective views illustrating lower tray area detecting sensors configured to detect a position of the lower stacking tray in a sheet stacking height direction according to the embodiment.
Figure 9B:
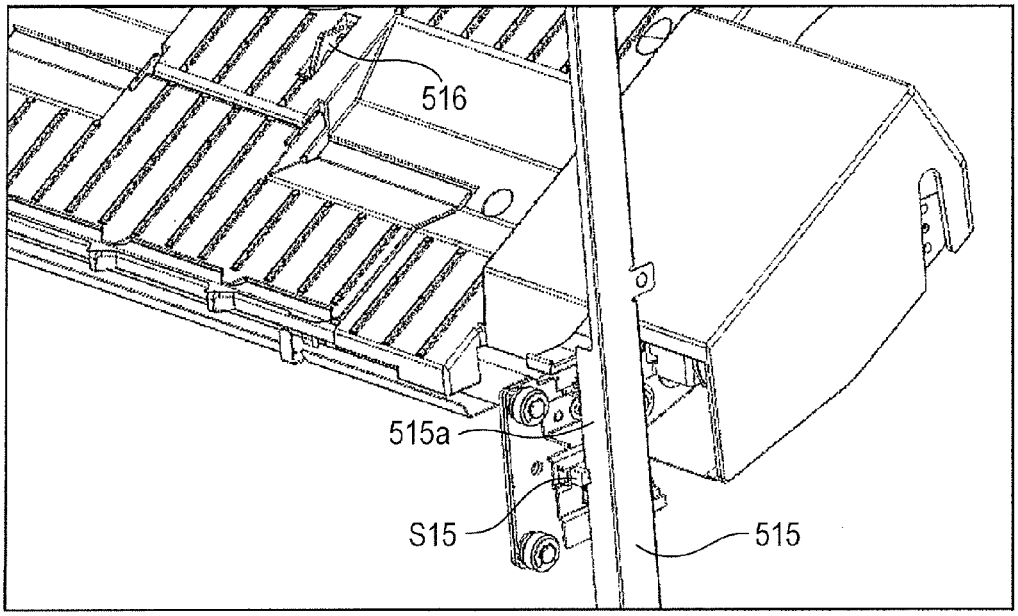

Next, a raising/lowering mechanism of the lower stacking tray 137 for stacking the discharged sheets thereon and movement control in a sheet stacking height direction are described with reference to FIGS. 8A, 8B, 8C, 9A, 9B, and 10. First, the raising/lowering mechanism of the lower stacking tray 137 is described with reference to FIGS. 8A to 8C and 9A to 9C. FIGS. 8A to 8C are perspective views illustrating the lower stacking tray 137 provided to the finisher 100 according to this embodiment. FIGS. 9A and 9B are perspective views illustrating lower tray area detecting sensors S15 to S17 configured to detect a position of the lower stacking tray 137 in the sheet stacking height direction according to this embodiment.

As illustrated in FIGS. 8A and 8B, the lower stacking tray 137 includes a raising/lowering unit 500, and is raised and lowered by a pair of pinion gears 501*a* and 501*b* built in the raising/lowering unit 500 moving on a pair of racks 509*a* and 509*b*, respectively. As illustrated in FIG. 8C, the pinion gear 501*a* is connected to a first raising/lowering gear 502 through an intermediation of a second raising/lowering gear 503 and a third raising/lowering gear 504, and the first raising/lowering gear 502 is connected to a raising/lowering pulley 505. The raising/lowering pulley 505 is connected to a lower tray raising/lowering motor M13 through an intermediation of a raising/lowering belt 506. The pinion gear 501*b* is connected to the third raising/lowering gear 504 through an intermediation of a raising/lowering shaft 507. In this manner, the lower stacking tray 137 is raised and lowered when the pinion gear 501*a* and the pinion gear 501*b* rotate in synchronization with each other through the drive of the lower tray raising/lowering motor M13 and therefore move on the racks 509*a* and 509*b*, respectively.

An encoder 520 is fixed to the first raising/lowering gear 502, and a lower tray position detecting sensor S13 detects ON and OFF of the encoder 520, to thereby detect the rotation amount of the lower tray raising/lowering motor M13. Based on the rotation amount of the lower tray raising/lowering motor M13, the lowering amount of the lower stacking tray 137 is detected. Thus, it is possible to detect how much the lower stacking tray 137 is lowered from the initial position. The initial position refers to a position at which the lower stacking tray 137 is located when the job is started, and this position is hereinafter referred to as "home position". The encoder 520 and the lower tray position detecting sensor S13 may constitute a stacking tray position detecting portion and also constitute a stacking amount detecting portion.

As illustrated in FIG. 9A, on the rear side (raising/lowering unit 500 side) of the lower stacking tray 137, the lower tray area detecting sensors S15 to S17 are fixed at the end portion on the upstream side in parallel in the discharge direction to serve as the stacking tray position detecting portion which may constitute the stacking amount detecting portion. The ON and OFF of the lower tray area detecting sensors S15 to S17 are switched when multiple flag portions as the stacking tray position detecting portion, which are provided at predetermined positions of an area detecting plate 515, block light of the lower tray area detecting sensors S15 to S17, respectively. The position of the lower stacking tray 137 in the sheet stacking height direction is detected when the ON and OFF of the lower tray area detecting sensors S15 to S17 are switched by the multiple flag portions provided at the predetermined positions of the area detecting plate 515.

For example, when the lower stacking tray 137 is located at the home position, the lower tray area detecting sensor S15 is turned ON through the light blocking of a flag portion 515*a* illustrated in FIG. 9B, and the light of the lower tray area detecting sensors S16 and S17 is not blocked (the lower tray area detecting sensors S16 and S17 are kept OFF). When the lower tray area detecting sensor S15 is turned ON and the lower tray area detecting sensors S16 and S17 are kept OFF, it is determined that the lower stacking tray 137 is located at the home position. After that, when the stacking amount of the sheets increases and the lower stacking tray 137 is lowered down to a first height, the lower tray area detecting sensor S16 is turned ON through the light blocking of a flag portion (not shown) provided to the area detecting plate 515, and the light of the lower tray area detecting sensor S17 is not blocked (the lower tray area detecting sensor S17 is kept OFF). When the lower tray area detecting sensors S15 and S16 are turned ON and the lower tray area detecting sensor S17 is kept OFF, it is determined that the lower stacking tray 137 is located at the first height. When the stacking amount of the sheets further increases and the lower stacking tray 137 is lowered down to a second height, the lower tray area detecting sensor S17 is also turned ON through the light blocking of a flag portion (not shown) provided to the area detecting plate 515. When the lower tray area detecting sensors S15, S16, and S17 are turned ON, it is determined that the lower stacking tray 137 is located at the second height.

The finisher 100 according to this embodiment includes two types of sensors configured to detect the position of the lower stacking tray 137 in the sheet stacking height direction. For example, through the detection of the encoder 520, the movement amount of the lower stacking tray 137 can be detected finely. Further, deviation may occur between the actual movement amount and the detection amount when the lower stacking tray 137 is raised and lowered repeatedly due to looseness occurring in the drive portion or the like. Even in this case, through the detection of the lower tray area detecting sensors S15 to S17, it is possible to detect a situation that the lower stacking tray 137 is lowered down to a predetermined position.

In this embodiment, the lower tray area detecting sensors S15 to S17 are used for detecting the first height and the second height of the lower stacking tray 137, but the present invention is not limited thereto. For example, multiple lower tray area detecting sensors may be used for detecting multiple positions in the sheet stacking height direction in a stepwise manner.

Figure 10:
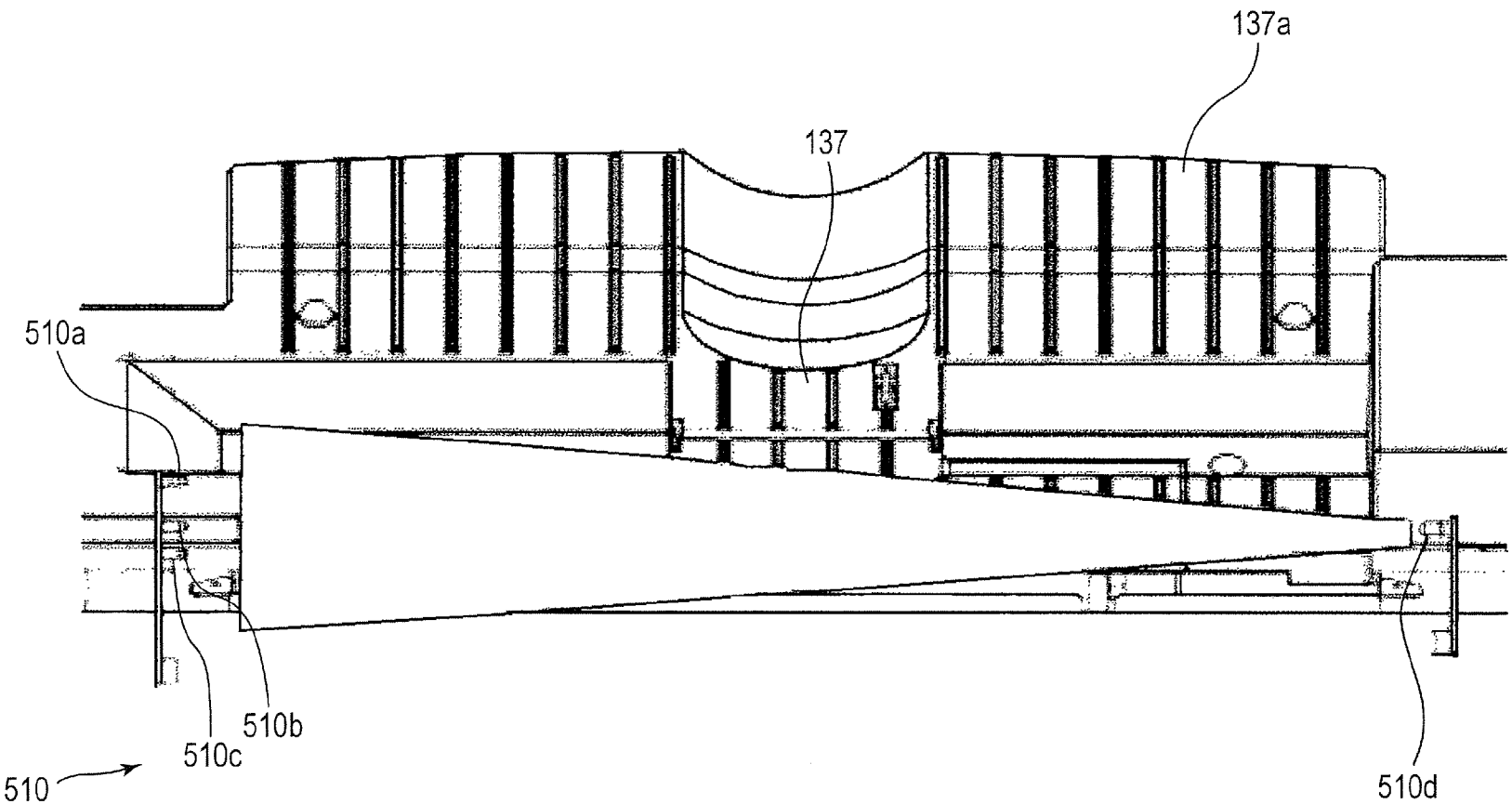
FIG. 10 illustrates a sheet stacking height detecting sensor configured to detect a sheet stacking height of sheets stacked on the lower stacking tray according to the embodiment.

Next, an operation of controlling the lower stacking tray 137 in the sheet stacking height direction is described with reference to FIG. 10. FIG. 10 is an illustration of the sheet stacking height detecting sensor 510 configured to detect the stacking height (top surface position) of the sheets stacked on the lower stacking tray 137 according to this embodiment.

The movement control of the lower stacking tray 137 in the sheet stacking height direction is performed when the sheet stacking height detecting sensor 510 detects a stacking surface 137*a* of the lower stacking tray 137 and the top surface position in the sheet stacking height direction of the sheets stacked on the stacking surface 137*a*. The sheet stacking height detecting sensor 510 is provided below the bundle discharge roller pair 130 and on the upstream side (on the abutment member side) of the lower stacking tray 137 so as not to affect the discharge of the sheet. At this position, the sheet stacking height detecting sensor 510 detects the position in the sheet stacking height direction.

As illustrated in FIG. 10, the sheet stacking height detecting sensor 510 includes a first light receiving sensor 510*a*, a second light receiving sensor 510*b*, a third light receiving sensor 510*c*, and a light emitting sensor 510*d*. The sheet stacking height detecting sensor 510 detects ON and OFF of the respective sensors when light emitted from the light emitting sensor 510*d* and received by the first to third light receiving sensors 510*a* to 510*c* is blocked by the stacked sheets or the like. The lower stacking tray 137 is raised and lowered in accordance with a detection result of the sheet stacking height detecting sensor 510.

For example, at the start of the job when no sheet is stacked on the lower stacking tray 137 (for example, when the lower stacking tray 137 is located at the home position), the light of only the third light receiving sensor 510*c* is blocked by the lower stacking tray 137 so that the third light receiving sensor 510*c* is brought into an ON state. When only the third light receiving sensor 510*c* is brought into the ON state, it is determined that no sheet is stacked on the lower stacking tray 137 or the stacking height is small, and therefore the lower stacking tray 137 is not lowered. After that, when the sheets are sequentially stacked and the light of the second light receiving sensor 510*b* is blocked by the stacked sheets so that the second light receiving sensor 510*b* is brought into an ON state, the lower tray raising/lowering motor M13 is driven and the lower stacking tray 137 is lowered until the second light receiving sensor 510*b* is brought into an OFF state (light receiving state). Every time the second light receiving sensor 510*b* is brought into the ON state, the lower tray raising/lowering motor M13 is driven and the lower stacking tray 137 is lowered repeatedly. In this manner, the sheets are sequentially stacked while lowering the lower stacking tray 137. A lower tray sheet presence/absence detecting sensor S21 and a sheet presence/absence detecting flag 516 are provided to the lower stacking tray 137, and the presence and absence of the sheet are detected based on the ON and OFF of the lower tray sheet presence/absence detecting sensor S21.

Figure 11A:
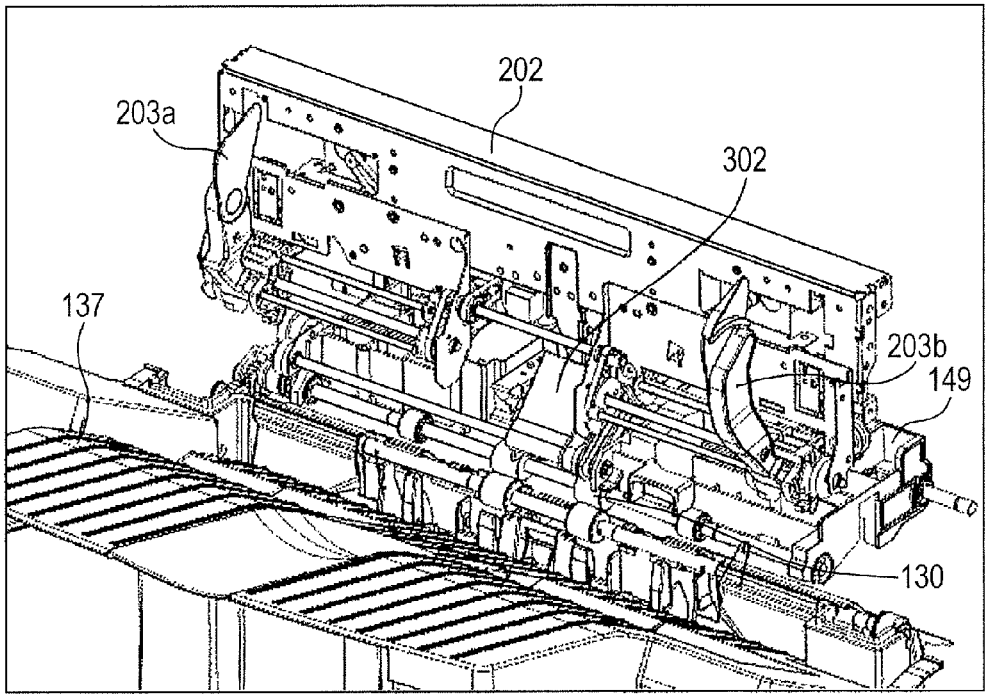
FIGS. 11A and 11B illustrate a state in which a front alignment member, a rear alignment member, a paddle holder, and the lower stacking tray are located at their home positions.
Figure 11B:
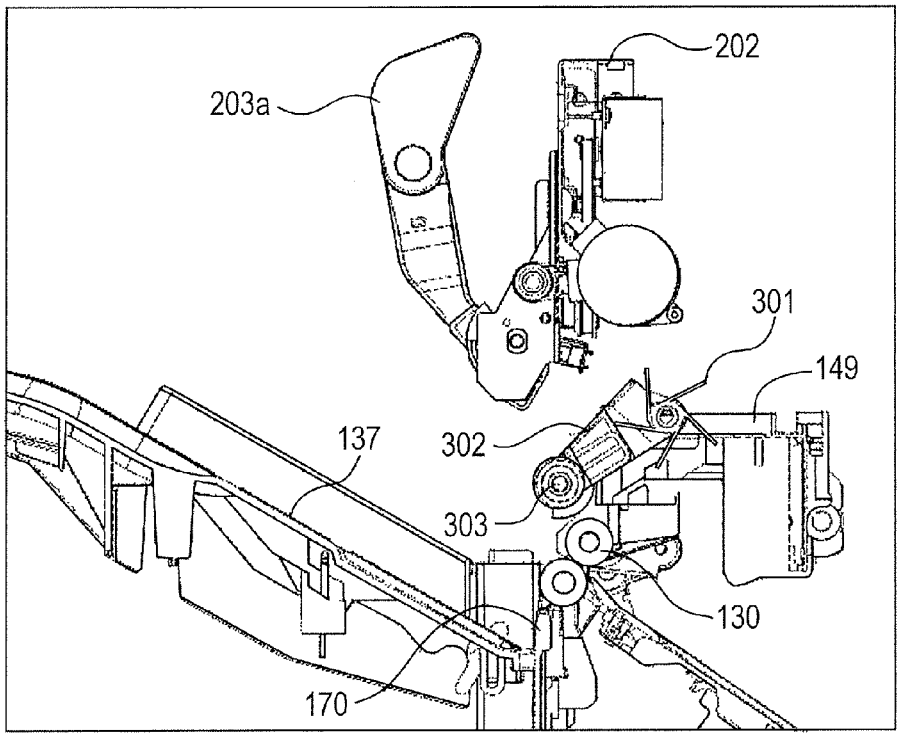
Figure 12A:
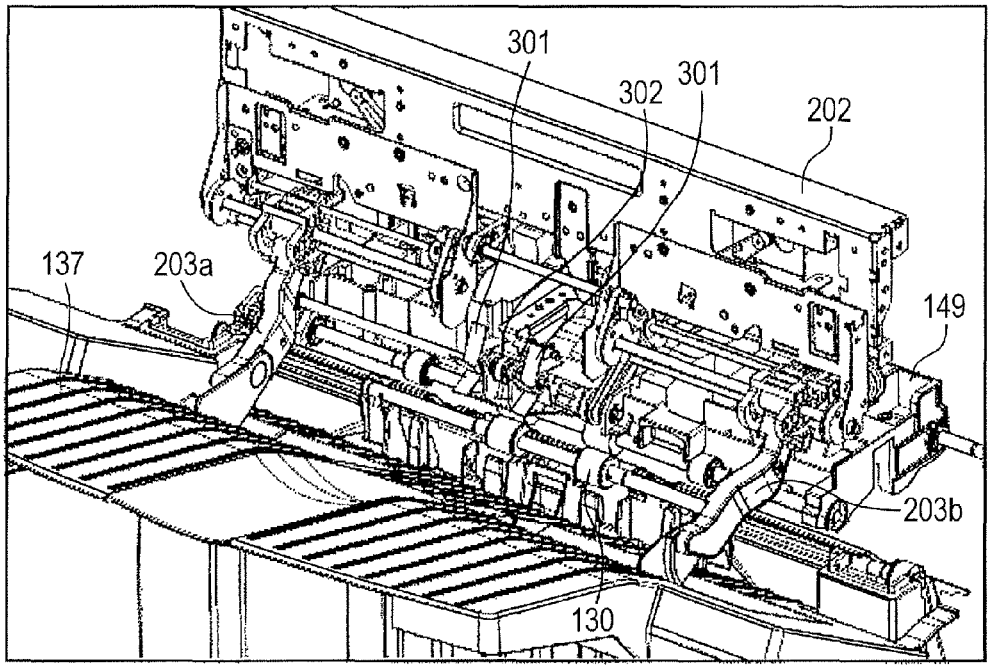
FIGS. 12A and 12B illustrate a state in which the front alignment member, the rear alignment member, and the paddle holder are moved to their sheet receiving positions.
Figure 12B:
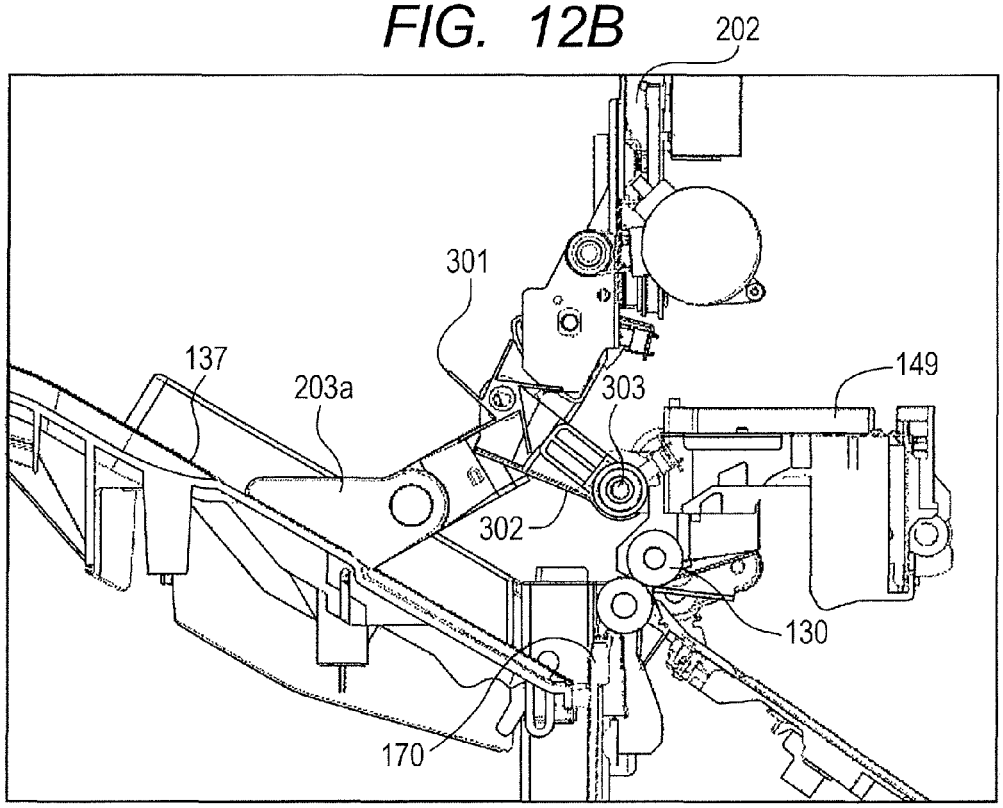
Figure 13:
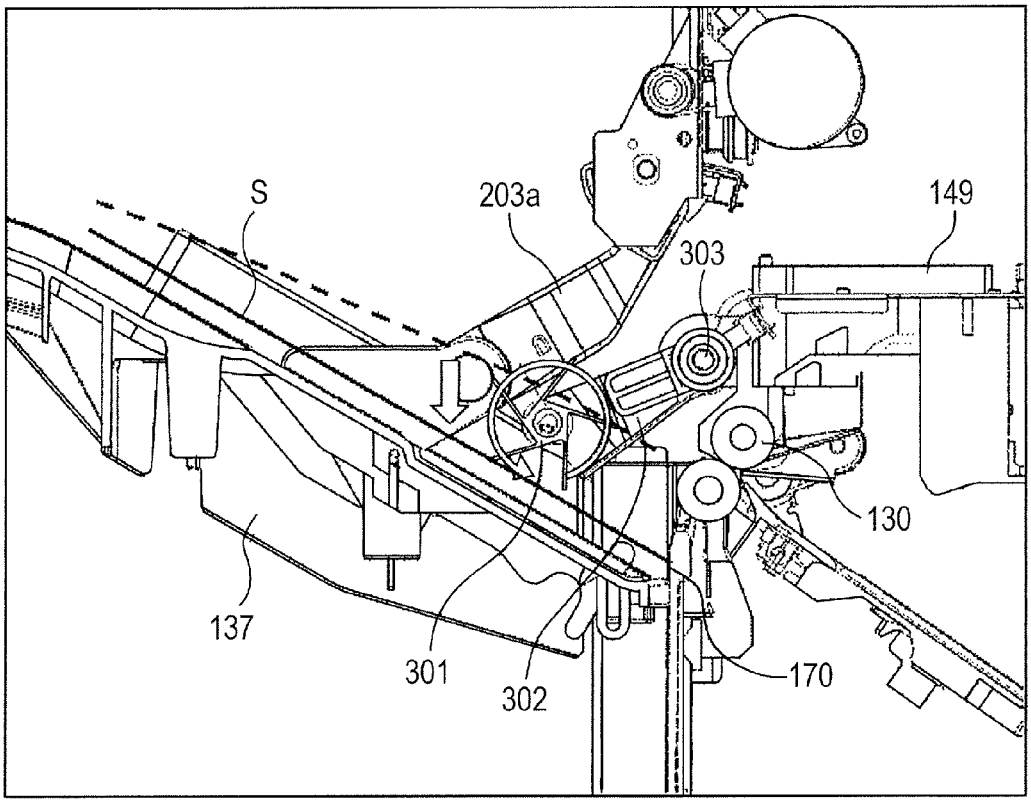
FIG. 13 illustrates a state in which the tray paddles at a first transporting position align the sheets in a discharge direction.
Figure 14A:
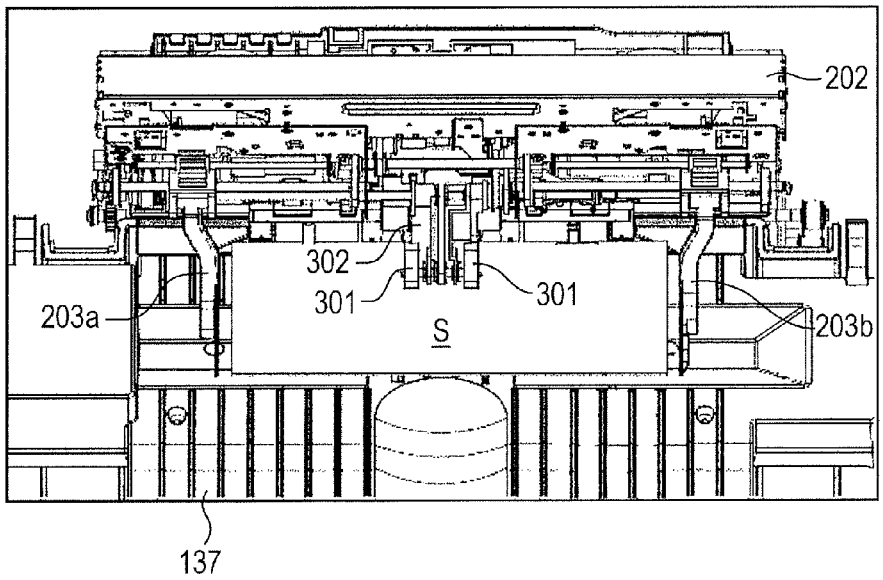
FIGS. 14A, 14B, and 14C illustrate a state in which the front alignment member and the rear alignment member align the sheets in a width direction.
Figure 14B:
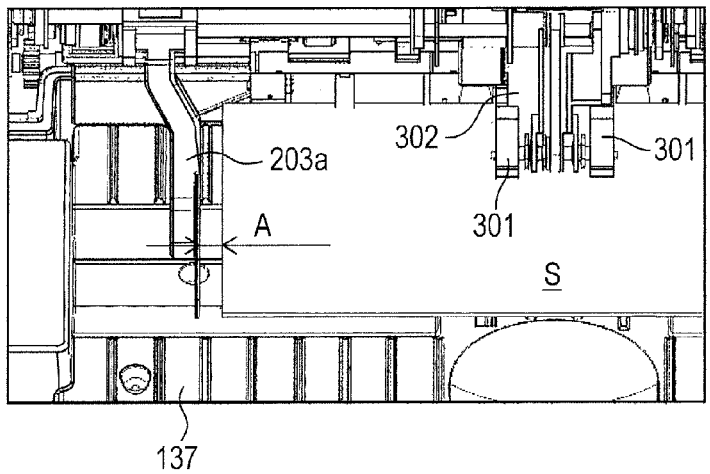
Figure 14C:
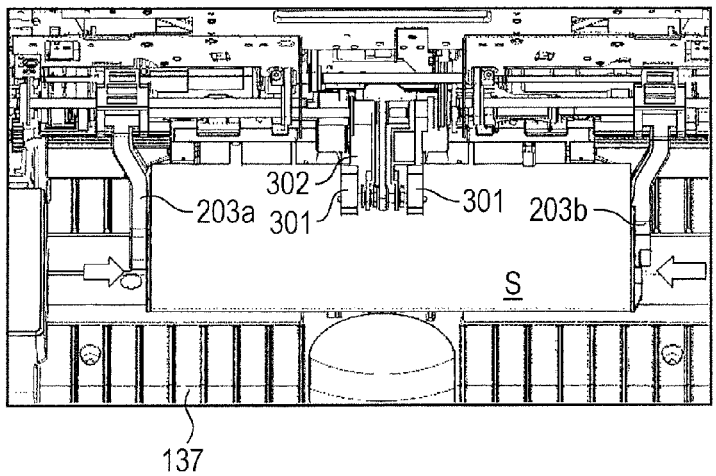
Figure 15A:
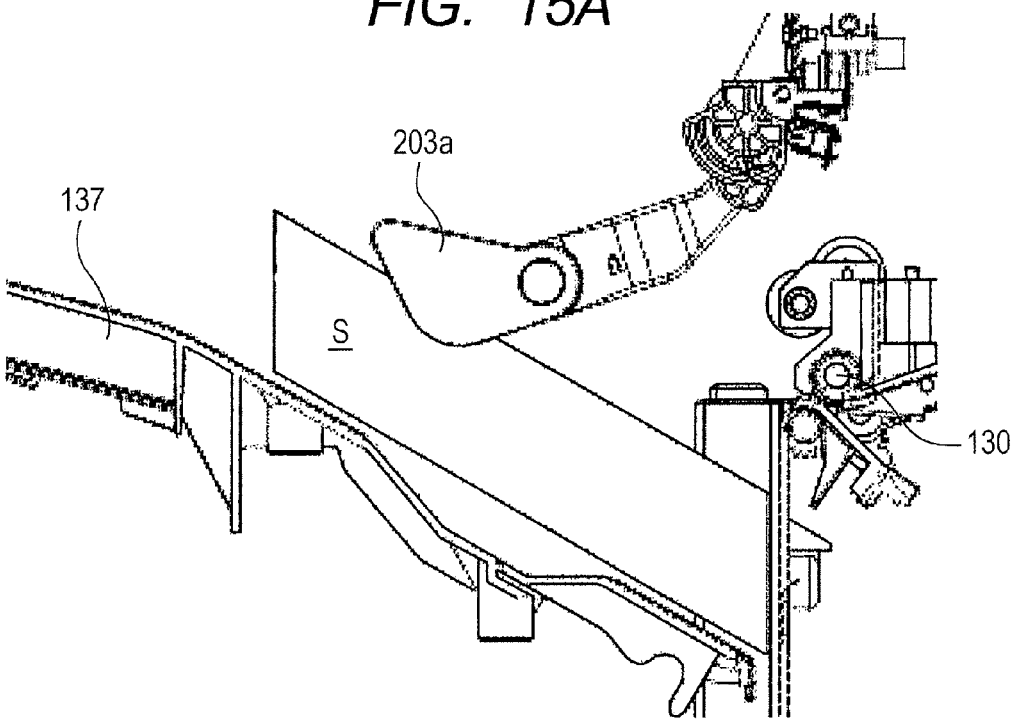
FIGS. 15A and 15B illustrate a state in which the front alignment member and the rear alignment member align the sheets in the width direction while further lowering the front alignment member and the rear alignment member in accordance with the position of the lower stacking tray in the sheet stacking height direction.
Figure 15B:
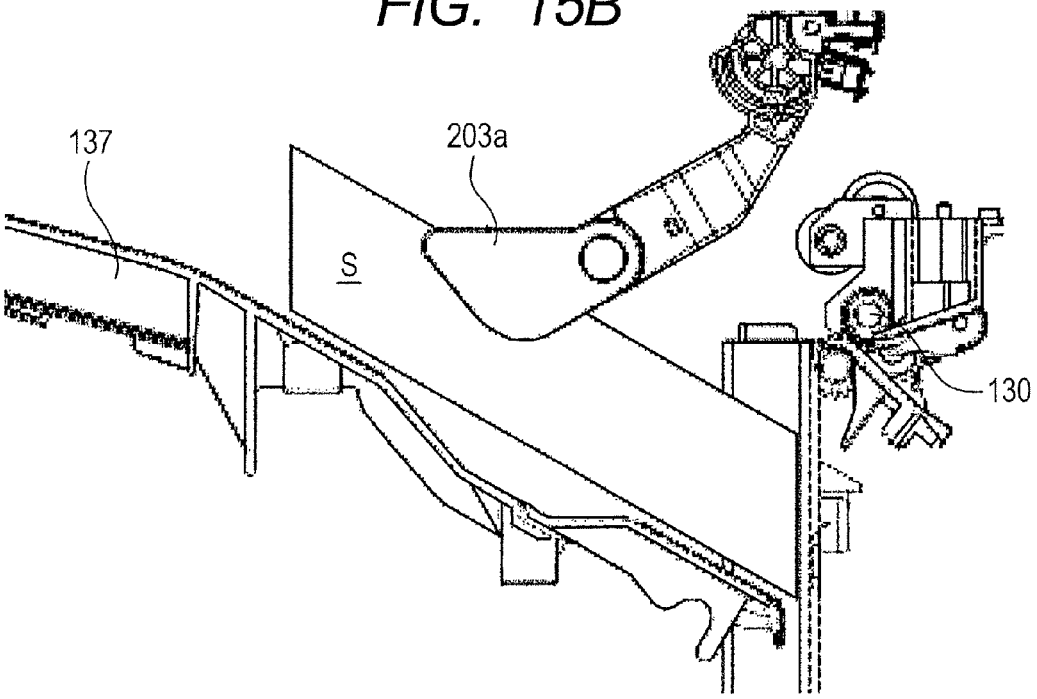
Figure 16:
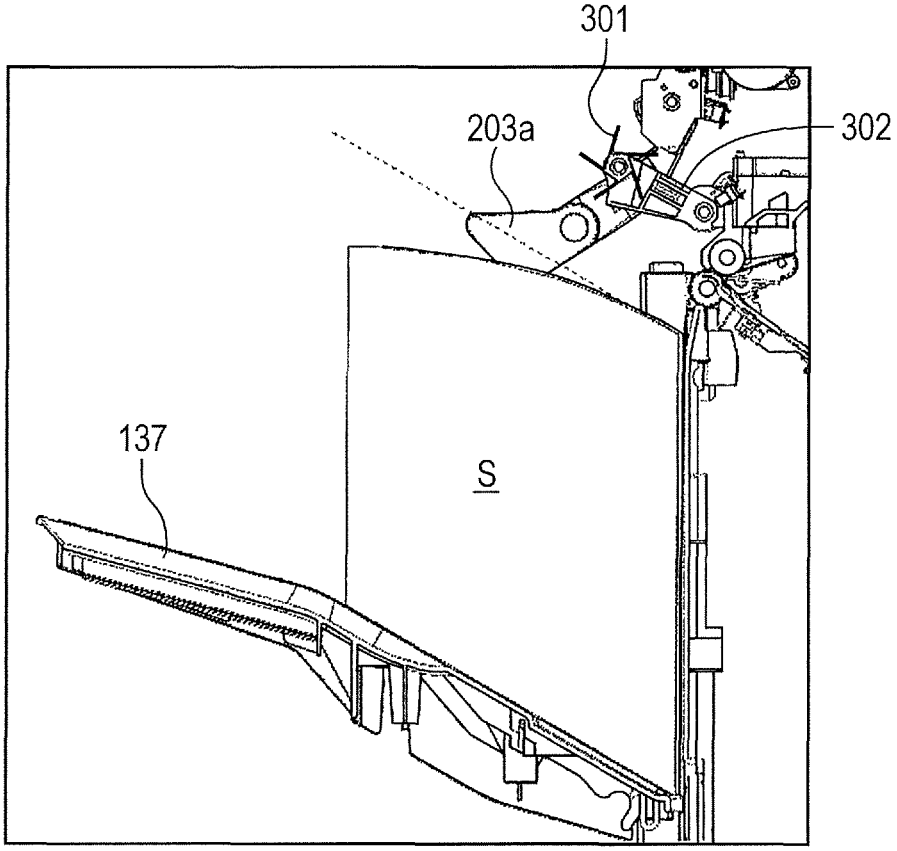
FIG. 16 illustrates a state in which the lower stacking tray is lowered down to a second height along with increase in number of the sheets stacked on the lower stacking tray.
Figure 17:
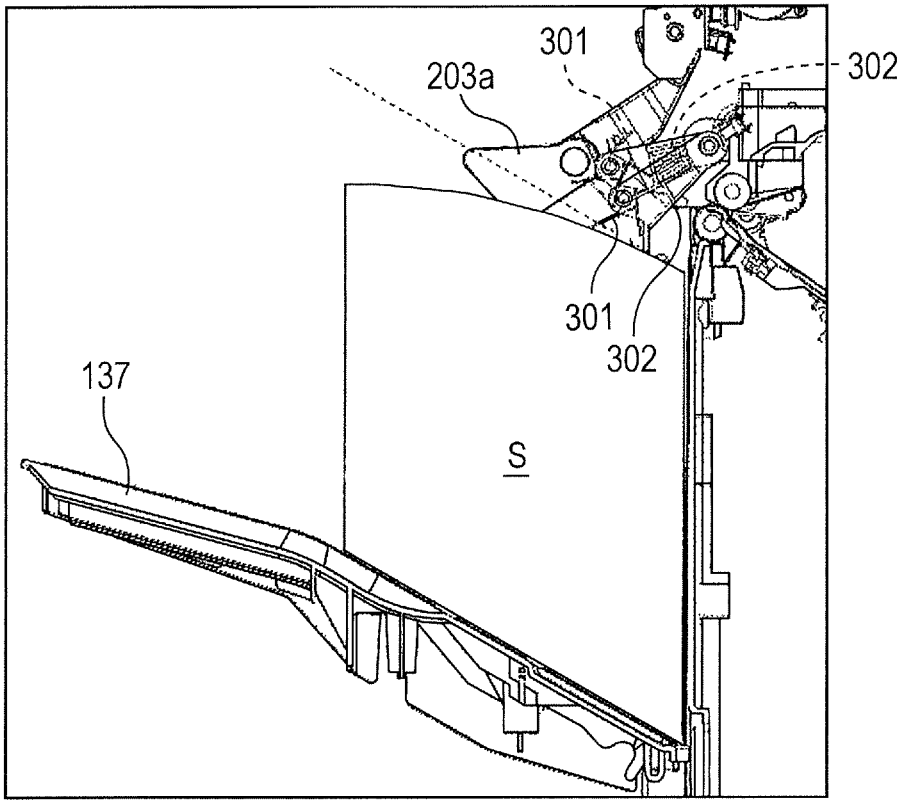
FIG. 17 illustrates a state in which the tray paddles are lowered from the first transporting position to a second transporting position.
Figure 18:
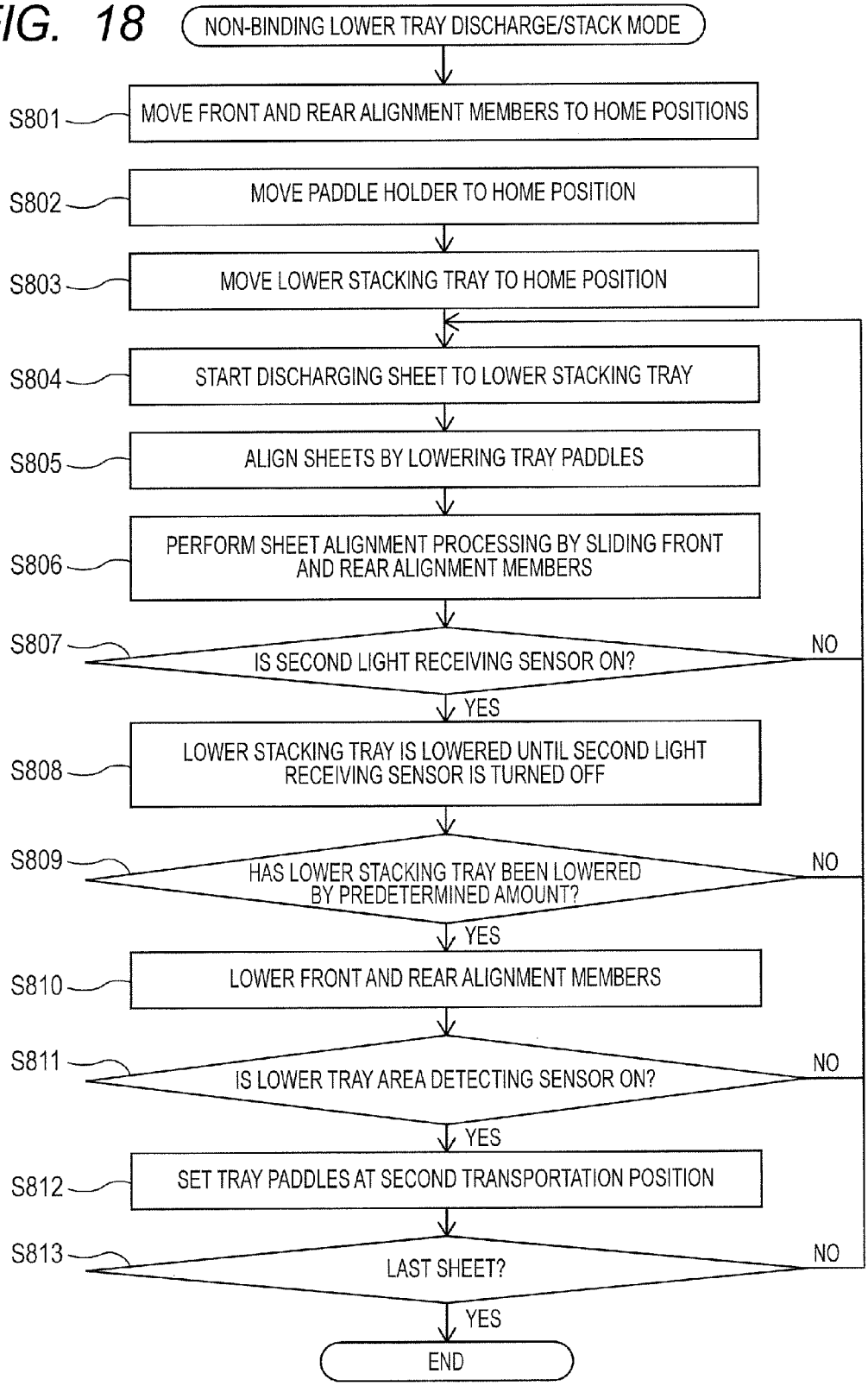
FIG. 18 is a flow chart illustrating an operation of the finisher for stacking the sheets onto the lower stacking tray according to the embodiment.
Figure 19A:
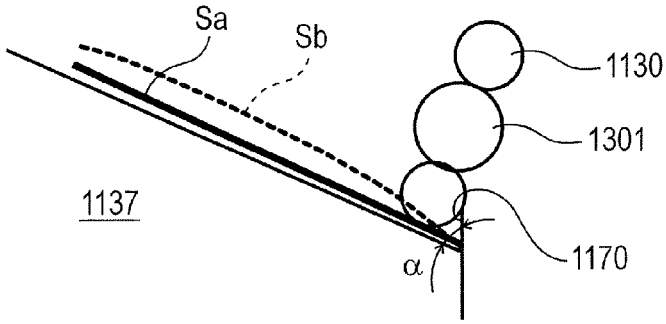
FIGS. 19A and 19B are schematic sectional views illustrating a stacking tray of a sheet stacking apparatus according to a conventional example.
Figure 19B:
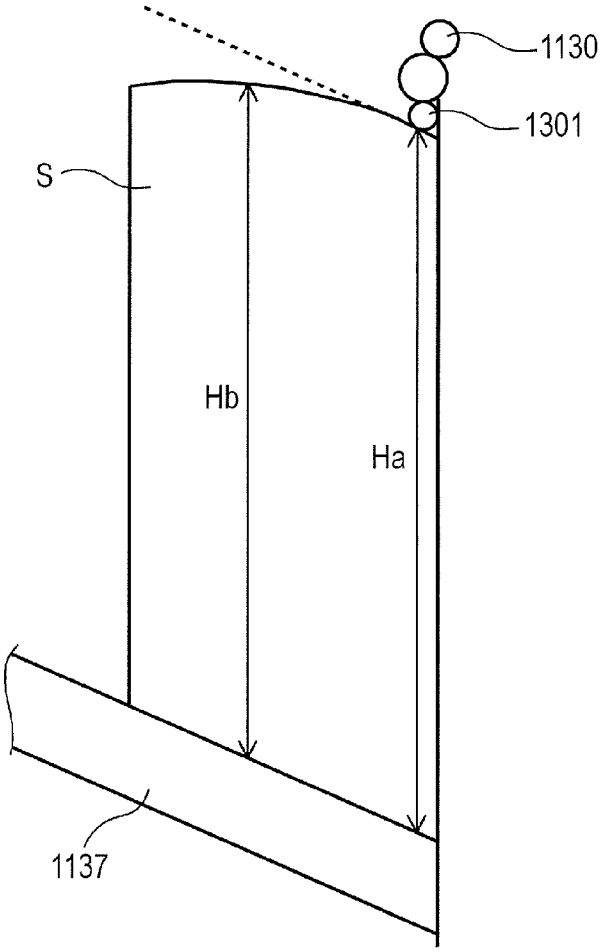

Next, an operation of stacking the sheets onto the lower stacking tray by the finisher 100 according to this embodiment is described with reference to FIGS. 11A, 11B, 12A, 12B, 13, 14A, 14B, 14C, 15A, 15B, 16, and 17 along with a flow chart of FIG. 18. FIGS. 11A and 11B illustrate a state in which the front alignment member 203*b*, the rear alignment member 203*a*, the paddle holder 302, and the lower stacking tray 137 are located at their home positions. FIGS. 12A and 12B illustrate a state in which the front alignment member 203*b*, the rear alignment member 203*a*, and the paddle holder 302 are moved to their sheet receiving positions. FIG. 13 illustrates a state in which the tray paddles 301 at the first transporting position align the sheets in the discharge direction. FIGS. 14A to 14C illustrate a state in which the front alignment member 203*b* and the rear alignment member 203*a* align the sheets in the width direction. FIGS. 15A and 15B illustrate a state in which the front alignment member 203*b* and the rear alignment member 203*a* align the sheets in the width direction while further lowering the front alignment member 203*b* and the rear alignment member 203*a* in accordance with the stacking height (top surface position) of the lower stacking tray 137. FIG. 16 illustrates a state in which the lower stacking tray 137 is lowered down to the second height along with increase in number of the sheets stacked on the lower stacking tray 137. FIG. 17 illustrates a state in which the tray paddles 301 are lowered from the first transporting position to the second transporting position. FIG. 18 is a flow chart illustrating the operation of the finisher 100 for stacking the sheets onto the lower stacking tray 137 according to this embodiment.

When the user sets a non-binding lower discharge/stack mode and the non-binding lower discharge/stack mode is started, the front alignment member 203*b* and the rear alignment member 203*a* are caused to perform initial operations and therefore move to their home positions (Step S801). Similarly, the paddle holder 302 is caused to perform an initial operation and therefore move to its home position, and further, the lower stacking tray 137 is caused to perform an initial operation and therefore move to its home position (Steps S802 and S803). When the front alignment member 203*b*, the rear alignment member 203*a*, the paddle holder 302, and the lower stacking tray 137 are caused to perform the initial operations and therefore move to their home positions or initial positions, the state of FIGS. 11A and 11B is obtained.

After the initial operations are completed, the front alignment member 203*b*, the rear alignment member 203*a*, and the tray paddles 301 are moved to the receiving positions of FIGS. 12A and 12B. First, in accordance with sheet size information input through the operation portion 601, the front alignment member 203*b* and the rear alignment member 203*a* are slid in the front-rear direction by a predetermined amount, and then pivoted by a predetermined amount. Similarly, the paddle holder 302 is pivoted by a predetermined amount. The receiving position refers to such a position that the distance between the front alignment member 203*b* and the rear alignment member 203*a* is set larger by a predetermined amount than the length of the sheet in the width direction and therefore the front alignment member 203*b* and the rear alignment member 203*a* do not become an obstacle to the sheet to be discharged, and that the tray paddles 301 do not come into contact with the sheet that is being discharged. The home position of the lower stacking tray 137 corresponds to the receiving position, and hence the lower stacking tray 137 is ready to receive the sheet.

Subsequently, the sheet having an image formed thereon through the above-mentioned image forming operation is sent from the discharge roller pair 907 of the copying machine 600 into the finisher 100, and is discharged from the bundle discharge roller pair 130 to the lower stacking tray 137 (Step S804). When the trailing edge of the sheet passes through a nip of the bundle discharge roller pair 130, the tray paddles 301 are lowered from the sheet receiving position to the first transporting position. When the tray paddles 301 are lowered, the tray paddles 301 come into contact with the sheet discharged from the bundle discharge roller pair 130, and drop the sheet onto the lower stacking tray 137. At this time, the tray paddles 301 rotate in synchronization with the bundle discharge roller pair 130. Therefore, as illustrated in FIG. 13, a sheet S is brought into abutment on the abutment member 170 while being dropped onto the lower stacking tray 137 so that the sheet S is aligned in the discharge direction (Step S805). The paddle holder 302 starts to pivot at a timing after a predetermined period of time since the passage of the trailing edge of the sheet S through the nip. The tray paddles 301 rotate at the first transporting position (position of FIG. 13) for a predetermined period of time, and are then raised to the receiving position (position of FIGS. 12A and 12B).

Subsequently, as illustrated in FIGS. 14A to 14C, the front alignment member 203*b* and the rear alignment member 203*a* held in a standby state at the positions with the distance therebetween larger by a predetermined amount (indicated by the symbol "A" of FIG. 14B) than the length of the sheet S in the width direction are moved to have a distance equal to the width of the sheet S, to thereby sandwich the sheet S for alignment in the width direction. When the sheet S is sandwiched for alignment in the width direction, the state of FIG. 14C is obtained, and the sheet S is aligned in the width direction at a predetermined position on the lower stacking tray 137 (Step S806). When the alignment of the sheet S in the width direction is completed, the front alignment member 203*b* and the rear alignment member 203*a* are moved to the receiving positions of FIGS. 12A and 12B to serve for reception of the succeeding sheet S.

Subsequently, the state of the second light receiving sensor 510*b* is confirmed, and when the second light receiving sensor 510*b* is turned ON, the lower stacking tray 137 is lowered until the second light receiving sensor 510*b* is turned OFF (Steps S807 and S808). When the second light receiving sensor 510*b* is kept OFF, the succeeding sheet is received, and this operation is performed every time the sheet is discharged. In this manner, the sheet discharge, the alignment in the discharge direction, the alignment in the width direction, and the lowering of the lower stacking tray 137 are repeated to sequentially stack the sheets on the lower stacking tray 137.

When the above-mentioned control is continuously performed and the lower stacking tray 137 accordingly moves to a position at which the lower stacking tray 137 is lowered by a given amount from the home position, the lower tray position detecting sensor S13 detects that the lower stacking tray 137 is lowered by the given amount (Step S809). Then, the alignment member raising/lowering motor M11 is driven to move and lower the front alignment member 203*b* and the rear alignment member 203*a* from the position of FIG. 15A to the position of FIG. 15B which enables the alignment of the sheets in the width direction (Step S810). When the stacking amount of the sheets stacked on the lower stacking tray 137 has exceeded a predetermined amount, the front alignment member 203*b* and the rear alignment member 203*a* are lowered to the position which enables the alignment of the sheets in the width direction. Accordingly, for example, even under a state in which the sheets assume a horizontal posture on their downstream side (see FIG. 16), the front alignment member 203*b* and the rear alignment member 203*a* can align the sheets in the width direction. The state in which the sheets assume a horizontal posture refers to a state in which the inclination of the topmost sheet stacked on the lower stacking tray 137 is reduced to approximate a horizontal posture.

When the lower stacking tray 137 is lowered down to the first height along with the increase in stacking amount of the sheets S stacked on the lower stacking tray 137, the lower tray area detecting sensor S16 is turned ON (Step S811). When the lower tray area detecting sensor S16 is turned ON, the pivot amount of the paddle holder 302 is set to an amount to reach the second transporting position, which achieves reduction in relative distance between the tray paddles 301 and the sheets stacked on the lower stacking tray 137 (Step S812). That is, after the stacking amount of the sheets has exceeded a predetermined stacking amount, the pivot amount of the paddle holder 302 is set so that the tray paddles 301 transport the sheet at the second transporting position. The first transporting position and the second transporting position are switched during the sheet discharge, and hence the image formation and the like are not hindered during this period. After that, when the sheet is not the last sheet, the operation proceeds to Step S804 to repeat the above-mentioned processing, and when the sheet is the last sheet, the job is finished (Step S813).

As described above, in the finisher 100 according to this embodiment, when the stacking amount of the sheets stacked on the lower stacking tray 137 has exceeded a predetermined stacking amount, the tray paddles 301 are moved to the second transporting position below the first transporting position to transport the sheet toward the abutment member 170. Therefore, even when the inclination of the top surface of the sheet (topmost sheet) is reduced along with the increase in stacking amount of the sheets so that the top surface position of the sheet becomes lower at the first transporting position, the decrease in pressure of contact between the tray paddles 301 and the sheet can be prevented. Accordingly, it is possible to prevent the stack misalignment of the sheets caused by the situation that the sheets are not sufficiently transported. Further, the sheets are transported at the second transporting position below the first transporting position, and hence the transporting force can be increased.

Further, in the finisher 100 according to this embodiment, when the trailing edge of the sheet passes through the nip of the bundle discharge roller pair 130, the paddle holder 302 is pivoted to lower the tray paddles 301. Therefore, even when the inclination of the top surface of the sheet is reduced along with the increase in stacking amount of the sheets so that the traveling amount at the time of sheet discharge from the bundle discharge roller pair 130 may increase, the tray paddles 301 transport the sheet while dropping the sheet. Thus, it is possible to prevent such a situation that the sheet cannot be moved.

The embodiment of the present invention has been described above, but the present invention is not limited to the embodiment described above. Further, the effects described in the embodiment of the present invention are exemplified only as the most suitable effects produced from the present invention, and hence the effects of the present invention are not limited to those described in the embodiment of the present invention.

For example, in this embodiment, when the stacking amount of the sheets has exceeded a predetermined stacking amount, the paddle holder 302 is controlled to be lowered so as to bring the tray paddles 301 closer to the sheets stacked on the lower stacking tray 137. However, the present invention is not limited thereto. For example, the control may be performed so as to adjust the lowering amount of the lower stacking tray 137 or raise the lower stacking tray by a predetermined amount based on the relative distance between the tray paddles 301 and the sheets stacked on the lower stacking tray 137. That is, the lower stacking tray 137 may be moved to bring the sheets stacked on the lower stacking tray 137 closer to the tray paddles 301.

In this embodiment, when the lower stacking tray 137 is lowered down to the first height, the tray paddles 301 are lowered closer to the sheets stacked on the lower stacking tray 137. However, the present invention is not limited thereto. For example, the tray paddles may be lowered continuously in accordance with the top sheet height on the upstream side of the sheets stacked on the lower stacking tray. Further, multiple lower tray area detecting sensors and multiple flag portions may be provided to lower the tray paddles more finely in a stepwise manner. That is, the tray paddles 301 may be lowered along with the increase in stacking amount of the sheets stacked on the lower stacking tray 137.

In this embodiment, the stacking tray position detecting portion is used for detecting the stacking amount of the sheets based on the position of the stacking tray in the sheet stacking height direction. However, the present invention is not limited thereto. For example, a sheet counting portion configured to count the number of sheets discharged from the bundle discharge roller pair 130 may be provided so as to perform the above-mentioned control based on the number of sheets counted by the sheet counting portion. Further, the tray lowering amount may be detected based on the ON and OFF of the encoder 520 and the lower tray position detecting sensor S13 so as to perform control of lowering the transporting position of the tray paddles 301 finely. That is, the tray paddles 301 may be lowered along with the increase in stacking amount of the sheets stacked on the lower stacking tray 137.

This embodiment is directed to the case of the sheets stacked on the lower stacking tray 137, but the present invention is not limited thereto. The upper stacking tray 136 may be constructed similarly to the lower stacking tray so as to perform the control as described above for the sheets stacked on the upper stacking tray 136.

In this embodiment, the finisher control portion 618 is mounted to the finisher 100, and the finisher control portion 618 is controlled by the CPU circuit portion 610 mounted to the copying machine 600 connected online. However, the present invention is not limited thereto. For example, the finisher control portion 618 may be mounted to the copying machine 600 integrally with the CPU circuit portion 610 so that the finisher 100 is controlled on the copying machine 600 side.

This embodiment is directed mainly to an A4 sheet, a letter (LTR) size sheet, or other sheets which are short in the discharge direction (hereinafter referred to as "half size sheet"), but the present invention may be carried out also in a case of an A3 sheet, a tabloid or ledger (LDR) size sheet, or other sheets which are long in the discharge direction (large size). In the case of the large size, a return force larger than in the case of the half size is preferred because the size is larger. Therefore, despite the homonymous "first transporting positions", it is desired that the first transporting position for the large size be lower than that for the half size. For example, it is desired that the sheet be returned firmly by lowering in an order of the first transporting position for the half size, the first transporting position for the large size, the second transporting position for the half size, and the second transporting position for the large size.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-103013, filed Apr. 27, 2012, which is hereby incorporated by reference herein in its entirety.

What is claimed is:

1. A sheet stacking apparatus, comprising:

a sheet discharge portion configured to discharge a sheet;

a sheet stacking portion on which the sheet discharged by the sheet discharge portion is stacked;

an abutment portion against which an end portion of the sheet stacked on the stacking portion is abutted;

a position detecting portion configured to detect a position of a top sheet, which is stacked on the stacking portion, in a height direction;

a lowering portion configured to lower the stacking portion in accordance with a detection result obtained from the position detecting portion;

a transporting portion provided above the stacking portion so as to be capable of raising and lowering, the transporting portion configured to come into contact with the sheet discharged by the sheet discharge portion to transport the sheet toward the abutment portion and bring the sheet into abutment with the abutment portion;

a stacking amount detecting portion configured to detect a stacking amount of the sheet stacked on the stacking portion; and a control portion configured to perform control of a position of the transporting portion in the height direction where the transporting portion transports the sheet toward the abutment portion, in accordance with the stacking amount of the sheet stacked on the stacking portion which is detected by the stacking amount detecting portion.

2. A sheet stacking apparatus according to claim 1, wherein the stacking amount detecting portion comprises a stacking portion position detecting portion configured to detect a position of the stacking portion in the height direction.

3. A sheet stacking apparatus according to claim 2, wherein the control portion causes the transporting portion to transport the sheet toward the abutment portion at a first transporting position until the stacking portion position detecting portion detects the position of the stacking portion, which is lowered down to a predetermined position, in the height direction, and the control portion causes the transporting portion to lower down to a second transporting position below the first transporting position and to transport the sheet toward the abutment portion when the stacking portion position detecting portion detects the position of the stacking portion, which is lowered down to the predetermined position, in the height direction.

4. A sheet stacking apparatus according to claim 1, wherein the stacking amount detecting portion comprises a sheet counting portion configured to count a number of the sheets discharged from the sheet discharge portion.

5. A sheet stacking apparatus according to claim 4, wherein the control portion causes the transporting portion to lower to transport the sheet when the number of the sheets counted by the sheet counting portion exceeds a predetermined number.

6. A sheet stacking apparatus according to claim 1, wherein the transporting portion is provided above the sheet discharge portion, and is configured to bring the sheet into abutment on the abutment portion while dropping the sheet onto the stacking portion through lowering of the transporting portion when the sheet is discharged from the sheet discharge portion.

7. A sheet stacking apparatus according to claim 1, wherein the control portion causes the transporting portion to transport the sheet toward the abutment portion at a first transporting position when the stacking amount detecting portion detects the stacking amount equal to or less than a predetermined stacking amount, and the control portion causing the transporting portion to transport the sheet toward the abutment portion at a second transporting position below the first transporting position when the stacking amount detecting portion detects the stacking amount greater than the predetermined stacking amount.

8. An image forming apparatus, comprising:

an image forming portion configured to form an image on a sheet;

a sheet discharge portion configured to discharge the sheet on which the image is formed by the image forming portion;

a sheet stacking portion on which the sheet discharged from the sheet discharge portion is stacked;

an abutment portion against which an end portion of the sheet stacked on the stacking portion is abutted;

a position detecting portion configured to detect a position of a top sheet, which is stacked on the stacking portion, in a height direction, a lowering portion configured to lower the stacking portion in accordance with a detection result obtained from the position detecting portion;

a transporting portion provided above the stacking portion so as to be capable of raising and lowering, the transporting portion configured to come into contact with the sheet discharged by the sheet discharge portion to transport the sheet toward the abutment portion and bring the sheet into abutment with the abutment portion;

a stacking amount detecting portion configured to detect a stacking amount of the sheet stacked on the stacking portion; and a control portion configured to perform control of a position of the transporting portion in the height direction where the transporting portion transports the sheet toward the abutment portion, in accordance with the stacking amount of the sheet stacked on the stacking portion which is detected by the stacking amount detecting portion.

9. An image forming apparatus according to claim 8, wherein the stacking amount detecting portion comprises a stacking portion position detecting portion configured to detect a position of the stacking portion in the height direction.

10. An image forming apparatus according to claim 9, wherein the control portion causes the transporting portion to transport the sheet toward the abutment portion at a first transporting position until the stacking portion position detecting portion detects the position of the stacking portion, which is lowered down to a predetermined position, in the height direction, and the control portion causes the transporting portion to lower down to a second transporting position below the first transporting position and to transport the sheet toward the abutment portion when the stacking portion position detecting portion detects the position of the stacking portion, which is lowered down to the predetermined position, in the height direction.

11. An image forming apparatus according to claim 8, wherein the stacking amount detecting portion comprises a sheet counting portion configured to count a number of the sheets discharged from the sheet discharge portion.

12. An image forming apparatus according to claim 11, wherein the control portion causes the transporting portion to lower to transport the sheet when the number of the sheets counted by the sheet counting portion exceeds a predetermined number.

13. An image forming apparatus according to claim 8, wherein the transporting portion is provided above the sheet discharge portion, and is configured to bring the sheet into abutment on the abutment portion while dropping the sheet onto the stacking portion through lowering of the transporting portion when the sheet is discharged from the sheet discharge portion.

14. A sheet stacking apparatus according to claim 8, wherein the control portion causes the transporting portion to transport the sheet toward the abutment portion at a first transporting position when the stacking amount detecting portion detects the stacking amount equal to or less than a predetermined stacking amount, and the control portion causing the transporting portion to transport the sheet toward the abutment portion at a second transporting position below the first transporting position when the stacking amount detecting portion detects the stacking amount greater than the predetermined stacking amount.

15. A sheet stacking apparatus, comprising:

a sheet discharge portion configured to discharge a sheet;

a stacking portion on which the sheet discharged by the sheet discharge portion is stacked;

an abutment portion against which an end portion of the sheet stacked on the stacking portion is abutted; and a first detecting portion configured to detect a position of a top sheet, which is stacked on the stacking portion, in a height direction, a lowering portion configured to lower the stacking portion in accordance with a detection result obtained from the first detecting portion;

a transporting portion configured to come into contact with the sheet discharged by the sheet discharge portion to transport the sheet toward the abutment portion and bring the sheet into abutment on the abutment portion;

a second detecting portion configured to detect a position of the stacking portion in the height direction; and a control portion configured to perform control of a position of the transporting portion in the height direction, where the transporting portion transports the sheet toward the abutment portion, in accordance with the position of the stacking portion in the height direction which is detected by second detecting portion.

16. A sheet stacking apparatus according to claim 15, wherein the control portion causes the transporting portion to transport the sheet toward the abutment portion at a first transporting position until the second detecting portion detects the position of the stacking portion, which is lowered down to a predetermined position, in the height direction, and the control portion causes the transporting portion to lower down to a second transporting position below the first transporting position and to transport the sheet toward the abutment portion when the second detecting portion detects the position of the stacking portion, which is lowered down to the predetermined position, in the height direction.

17. A sheet stacking apparatus according to claim 16, wherein the transporting portion is provided above the sheet discharge portion, and is configured to bring the sheet into abutment on the abutment portion while dropping the sheet onto the stacking portion through lowering of the transporting portion when the sheet is discharged from the sheet discharge portion.

18. A sheet stacking apparatus, comprising:

a sheet discharge portion configured to discharge a sheet;

a stacking portion on which the sheet discharged from the sheet discharge portion is stacked;

an abutment portion against which an end portion of the sheet stacked on the stacking portion is abutted; and a position detecting portion configured to detect a position of a top sheet, which is stacked on the stacking portion, in a height direction, a lowering portion configured to lower the stacking portion in accordance with a detection result obtained from the position detecting portion;

a transporting portion configured to come into contact with the sheet discharged by the sheet discharge portion to transport the sheet toward the abutment portion and bring the sheet into abutment on the abutment portion;

a sheet counting portion configured to count a number of the sheets discharged from the sheet discharge portion; and a control portion configured to perform control of a position of the transporting portion in the height direction, where the transporting portion transports the sheet toward the abutment portion, in accordance with the number of the sheets counted by the sheet counting portion.

19. A sheet stacking apparatus according to claim 18, wherein the control portion causes the transporting portion to transport the sheet toward the abutment portion at a first transporting position until the number of the sheets counted by the sheet counting portion exceeds a predetermined number, and the control portion causes the transporting portion to transport the sheet at a second transporting position below the first transporting position when the number of the sheets counted by the sheet counting portion exceeds the predetermined number.

20. A sheet stacking apparatus according to claim 18, wherein the transporting portion is provided above the sheet discharge portion, and is configured to bring the sheet into abutment on the abutment portion while dropping the sheet onto the stacking portion through lowering of the transporting portion when the sheet is discharged from the sheet discharge portion.

* * * * *